US012655724B1

(12) United States Patent
McChesney et al.

(10) Patent No.: US 12,655,724 B1
(45) Date of Patent: Jun. 16, 2026

(54) METHOD TO OPTIMIZE RATE OF $CO_2$ MINERALIZATION DOWNHOLE

(71) Applicant: Halliburton Energy Services, Inc., Houston, TX (US)

(72) Inventors: Ryan W. McChesney, Carrollton, TX (US); Stephen Michael Greci, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 19/039,299

(22) Filed: Jan. 28, 2025

(51) Int. Cl.
*E21B 43/16* (2006.01)
*E21B 41/00* (2006.01)
*E21B 43/27* (2006.01)

(52) U.S. Cl.
CPC ..... *E21B 41/0064* (2013.01); *E21B 43/164* (2013.01); *E21B 43/27* (2020.05)

(58) Field of Classification Search
CPC ..... E21B 41/0064; E21B 43/27; E21B 43/164
See application file for complete search history.

(56) References Cited

U.S. PATENT DOCUMENTS 11,982,160 B1 5/2024 Ahmed et al.
2010/0116511 A1* 5/2010 Ramakrishnan ..... E21B 43/164 166/400
2010/0200465 A1* 8/2010 Dana ..... C10B 53/06 196/46
2013/0064604 A1 3/2013 Han et al.
2020/0368987 A1* 11/2020 Howard ..... B25B 5/163
2022/0364441 A1 11/2022 Nagra et al.
2023/0038447 A1* 2/2023 Hasan ..... E21B 43/164
2023/0313645 A1* 10/2023 Al-Qasim ..... E21B 41/0064 166/250.01
2024/0110464 A1 4/2024 Skeels
2024/0410258 A1 12/2024 Guo

FOREIGN PATENT DOCUMENTS

CN 117514096 A 2/2024
WO 2024220438 A2 10/2024

OTHER PUBLICATIONS

Foreign Communication from Related Application—International Search Report and Written Opinion of the International Searching Authority, International Application No. PCT/US2025/017042, dated Oct. 22, 2025, 10 pages.

* cited by examiner

*Primary Examiner* — Silvana C Runyan
(74) *Attorney, Agent, or Firm* — Conley Rose, P.C.; Rodney B. Carroll

(57) ABSTRACT

A method including pumping a solution comprising carbonic acid produced via contact of carbon dioxide and water into each of a plurality of zones of a formation, wherein the solution flows into one or more second via fractures or other permeabilities in the plurality of zones, and reacts with reactive rock in the plurality of zones or intervals of the formation to produce a solid and a resulting solution. The method further includes producing the resulting solution, and monitoring, via a sensor, a property of the resulting solution, and adjusting a flow rate of the pumping, a flow rate of the solution comprising carbonic acid flowing into one or more of the plurality of zones of the formation, a flow rate of the resulting solution flowing from one or more of the plurality of zones, or a combination thereof based on the property.

18 Claims, 6 Drawing Sheets

METHOD TO OPTIMIZE RATE OF $CO_2$ MINERALIZATION DOWNHOLE

CROSS-REFERENCE TO RELATED APPLICATIONS

None.

STATEMENT REGARDING FEDERALLY SPONSORED RESEARCH OR DEVELOPMENT

Not applicable.

BACKGROUND

The present disclosure relates generally to carbon dioxide sequestration; more specifically, this disclosure relates to carbon dioxide mineralization via carbonic acid injection; yet more specifically, this disclosure relates to carbon dioxide sequestration via carbonic acid reaction with a reactive rock of a formation and production of solid carbonate, with control of the reaction via the use of active and/or passive flow control devices.

BRIEF DESCRIPTION OF THE DRAWINGS

Illustrative examples of the present disclosure are described in detail below with reference to the attached drawing figures, which are incorporated by reference herein, wherein like reference numerals represent like parts and wherein.

Figure 1:
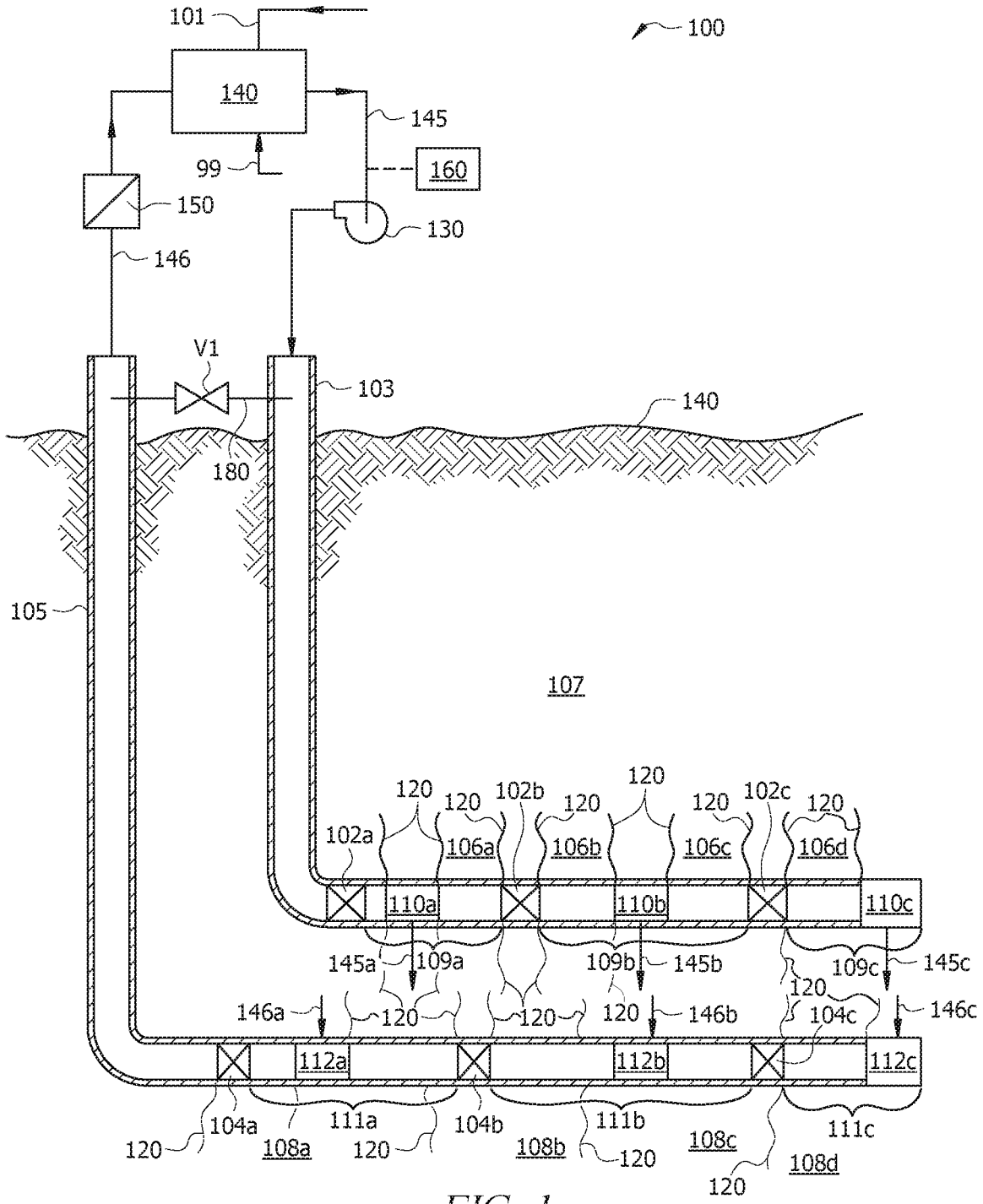
FIG. 1 is a schematic of a carbon dioxide sequestration system according to embodiments of this disclosure.

The illustrated figures are only exemplary and are not intended to assert or imply any limitation with regard to the environment, architecture, design, or process in which different examples may be implemented.

DETAILED DESCRIPTION

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

It should be noted that when "about" is used herein at the beginning of a numerical list, "about" modifies each number of the numerical list. Further, in some numerical listings of ranges, some lower limits listed may be greater than some upper limits listed. One skilled in the art will recognize that the selected subset will require the selection of an upper limit in excess of the selected lower limit. Unless otherwise indicated, all numbers expressing quantities of ingredients, particle sizes, reaction conditions, and so forth used in the present specification and associated claims are to be understood as being modified in all instances by the term "about." Accordingly, unless indicated to the contrary, the numerical parameters set forth in the following specification and attached claims are approximations that may vary depending upon the desired properties sought to be obtained by the illustrative embodiments described herein. At the very least, and not as an attempt to limit the application of the doctrine of equivalents to the scope of the claim, each numerical parameter should at least be construed in light of the number of reported significant digits and by applying ordinary rounding techniques. The term "about" as used herein can thus allow for a degree of variability in a value or range, for example, within 10%, within 5%, or within 1% of a stated value or of a stated limit of a range.

The term "substantially" as used herein refers to a majority of, or mostly, as in at least about 50%, 60%, 70%, 80%, 90%, 95%, 96%, 97%, 98%, 99%, 99.5%, 99.9%, 99.99%, or at least about 99.999% or more.

The term "downhole" as used herein refers to under the surface of the earth, such as a location within or fluidly connected to a wellbore.

If there is any conflict in the usages of a word or term in this specification and one or more patent or other documents that may be incorporated herein by reference, the definitions that are consistent with this specification should be adopted.

In the following detailed description of several illustrative examples, reference is made to the accompanying drawings that form a part hereof, and in which is shown by way of illustration specific examples that may be practiced. These examples are described in sufficient detail to enable those skilled in the art to practice them, and it is to be understood that other examples may be utilized and that logical structural, mechanical, electrical, and chemical changes may be made without departing from the spirit or scope of the disclosed examples. To avoid detail not necessary to enable those skilled in the art to practice the examples described herein, the description may omit certain information known to those skilled in the art. The following detailed description is, therefore, not to be taken in a limiting sense, and the scope of the illustrative examples are defined only by the appended claims.

Unless otherwise indicated, all numbers expressing quantities of ingredients, properties such as molecular weight, reaction conditions, and so forth used in the present specification and associated claims are to be understood as being modified in all instances by the term "about." Accordingly, unless indicated to the contrary, the numerical parameters set forth in the following specification and attached claims are approximations that may vary depending upon the desired properties sought to be obtained by the examples of the present invention. At the very least, and not as an attempt to limit the application of the doctrine of equivalents to the scope of the claim, each numerical parameter should at least be construed in light of the number of reported significant digits and by applying ordinary rounding techniques. It should be noted that when "about" is at the beginning of a numerical list, "about" modifies each number of the numerical list. Further, in some numerical listings of ranges some lower limits listed may be greater than some upper limits listed. One skilled in the art will recognize that the selected subset will require the selection of an upper limit in excess of the selected lower limit.

In the following discussion and in the claims, the terms "including" and "comprising" are used in an open ended fashion, and thus should be interpreted to mean "including, but not limited to." Unless otherwise indicated, as used throughout this document, "or" does not require mutual exclusivity.

The terms uphole and downhole can be used to refer to the location of various components relative to the bottom or end of a well. For example, a first component described as uphole from a second component can be further away from the end of the well than the second component. Similarly, a first component described as being downhole from a second component can be located closer to the end of the well than the second component.

Conventional methods to directly sequester carbon dioxide ($CO_2$) downhole include the injection of $CO_2$ in a supercritical state and the dissolution of $CO_2$ in water prior to injection. $CO_2$ injected in the supercritical state is typically intended to form a "plum" under a cap rock that will prevent the $CO_2$ from migrating back to surface. When the $CO_2$ is dissolved in water, it forms a weak acid, carbonic acid, which can react with formation rock downhole to form a solid state carbonate material. Once the carbonic acid has reacted with the formation to form the carbonate material, it can be stored permanently underground and cannot return to the surface, regardless of potential cap rock discontinuities, unlike those potentially encountered during injection of supercritical $CO_2$. However, the rate of $CO_2$ sequestration via the carbonic acid reaction can be limited by the reaction rate within the formation and the ability of the formation to absorb the injected fluid. Via the system and method of this disclosure, rather than allowing a static fluid to slowly react with the formation, the reaction kinetics are improved by (e.g., substantially constantly) circulating the acidic fluid (e.g., the carbonic acid solution) through the formation, and thus improving the rate and/or extent of $CO_2$ sequestration.

An array of injection and production wellbores (e.g., at least one first or injection wellbore and one second or production wellbore) coupled with passive (also referred to herein as "fixed") and/or active inflow control can be utilized according to this disclosure to expose the formation to a continuously refreshed (e.g., constant) supply of (e.g., low pH) carbonic acid solution. Circulating the fluid can minimize or prevent stagnation should an equilibrium be achieved between the injected fluid (e.g., the carbonic acid solution) and the formation rock. Installing passive flow control devices ("FCDs"; e.g., nozzle inflow control devices ICDs) and zonal isolation on one or more injection laterals (e.g., on a lateral of at least one or each of the first or injection well(s) can be employed to balance the outflow along the wellbores. To be able to adapt to changing conditions or reaction rates within the formation, variable flow control device(s) (e.g., electronic inflow control devices, eICD) can be utilized on the production well(s) to make it possible to react to changes in the formation, in near real time. In embodiments, the variable flow control device(s) (e.g., electronic inflow control devices, eICD) can detect or be actuated in response to changes in $CO_2$ concentration or production fluid pH, and either communicate that data to the surface or act autonomously to increase production rate through highly reactive portions of the wellbore and throttle flow in lower reactivity zones. As detailed further hereinbelow, recirculating fines or "re-fracking" the formation can also be utilized to expose new/fresh/unreacted formation rock surfaces to the acidic fluid (e.g., carbonic acid solution) and thus help maintain economically viable reaction rates.

With reference to FIG. 1, which is a schematic of a carbon dioxide sequestration system (also referred to more simply herein as a "carbon sequestration system" or a "system") according to embodiments of this disclosure, a system 100 of this disclosure can comprise one or more first (e.g., injection) wells 103, one or more second (e.g., production) wells 105, and a pump 130, and one or more flow control devices 110 associated with each first wellbore 103 and one or more flow control devices 112 associated with second wellbore 105. Each of the one or more injection wells 103 can be divided into isolated portions 109 via (e.g., and between adjacent pairs of) packers 102, wherein each of the isolated portions 109 of said each first well is configured for pumping of a solution of carbonic acid 145 into one of a plurality of zones or intervals 106 of a formation 107. Each of the one or more second (e.g., production) wells 105 can be divided into isolated portions 111 via (e.g., and between adjacent pairs of) packers 104, wherein each of the isolated portions 111 of said each second well 105 is configured for receiving a resulting solution 146 from one of the plurality of zones or intervals 108 of the formation 107. In the embodiment of FIG. 1 comprising one injection well 103 and one production well 105, first or injection well 103 is divided into three isolated portions 109, including first portion 109*a* between packer 102*a* and packer 102*b*, a second portion 109*b* between packer 102*b* and packer 102*c*, and a third portion 109*c* between packer 102*c* and an end of the first or injection wellbore 103; and second or production well 105 is divided into three isolated portions 111, including first portion 111*a* between packer 104*a* and packer 104*b*, a second portion 111*b* between packer 104*b* and packer 104*c*, and a third portion 111*c* between packer 104*c* and an end of the second or production wellbore 105. Pump 130 is configured for pumping the solution comprising carbonic acid 145 into the plurality of zones or intervals 106 of the formation 107 via the isolated portions 109 of the injection well 103, whereby the solution comprising carbonic acid 145 passes through formation 107 via fractures 120 or formation permeability thereof and reacts with the reactive rock of the formation 107 to produce a solid (e.g., carbonate) and the resulting solution 146, wherein the resulting solution 146 has a higher pH than a pH of the solution comprising carbonic acid originally injected (e.g., comprises less carbon dioxide than the injected solution).

Each of the one or more first (e.g., injection) wells 103 further comprises first well flow control devices 110, each of the flow control devices 110 configured to control a flow rate of the solution comprising carbonic acid 145 into one of the plurality of zones or intervals 106 of the formation 107; each of the one or more second (e.g., production) wells 105 further comprises second well flow control devices 112, each of the flow control devices 112 configured to control the flow rate of the resulting solution 146 from one of the plurality of zones or intervals 108 of the formation 107 into one of the second (producing) wells 105, or a combination thereof (e.g., a combination of first well control devices associated with at least one or each of the first wellbores 103 and second well control devices associated with at least one of or each of the second wellbores 105). The first well flow control devices 110 and second well flow control devices 112 can be collectively referred to herein as flow control devices or "FCDs".

In the embodiment of FIG. 1, first wellbore 103 include a first well control device 110*a* positioned in portion 109*a* of first wellbore 103 and configured to control a flow rate of the solution comprising carbonic acid 145*a* into zone or interval 106*a* of the formation 107; a first well control device 110*b* positioned in portion 109*b* of first wellbore 103 and configured to control a flow rate of the solution comprising carbonic acid 145*b* into zone or interval 106*b* of the formation 107; and a first well control device 110*c* positioned in portion 109*c* of first wellbore 103 and configured to control a flow rate of the solution comprising carbonic acid 145*c* into zone or interval 106*c* of the formation 107. In the embodiment of FIG. 1, second wellbore 105 include a second well control device 112*a* positioned in portion 111*a* of second wellbore 105 and configured to control the flow rate of the resulting solution 146*a* from zone or interval 108*a* of the formation 107 into second (producing) well 105; a second well control device 112*b* positioned in portion 111*b* of second wellbore 105 and configured to control the flow rate of the resulting solution 146*b* from zone or interval 108*b* of the formation 107 into second (producing) well 105, and a second well control device 112*c* positioned in portion 111*c* of second wellbore 105 and configured to control the flow rate of the resulting solution 146*c* from zone or interval 108*c* of the formation 107 into second (producing) well 105. The carbonic acid solution 145 can be provided from a tank 140 thereof, produced via combination of water (e.g., fresh water, brine, or wastewater makeup supply) and carbon dioxide 99 with the resulting solution 146 produced from second wellbore 105 (e.g., above the surface 140 and via the second well flow control devices 112).

Figure 2:
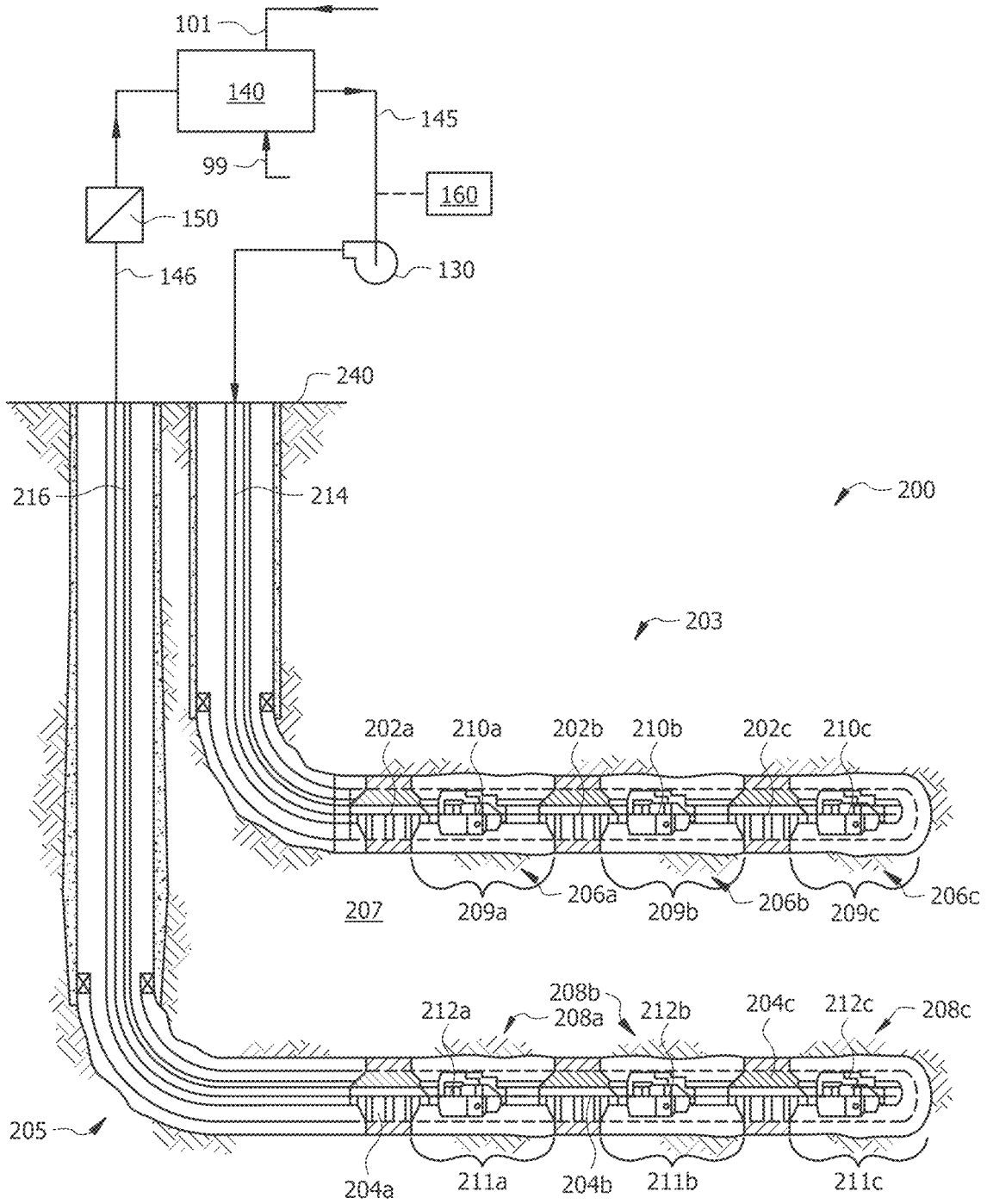
FIG. 2 is a schematic of a carbon dioxide sequestration system according to embodiments of this disclosure.

FIG. 2 is a schematic of a carbon dioxide sequestration system 200 according to embodiments of this disclosure, providing a more detailed schematic of a first wellbore 203 and second wellbore 205 according to embodiments of this disclosure. System 200 depicts two sets of isolation devices and two sets of flow control devices, one set of each per wellbore. A first set of isolation devices 202 can include isolation devices 202*a-c*, which can be positioned in a first wellbore 203 formed in a formation 207. The second set of isolation devices 204 can include isolation devices 204*a-c*, which can be positioned in a second wellbore 205 formed in the formation 207. The first isolation devices 202 can define a first set of isolated zones 206*a-c* in the first wellbore 203, and the second isolation devices 204 can define a second set of isolated zones 208*a-c* in the second wellbore 205. The first set of isolated zones 206*a-c* can connect, for example via fluid flow in fractures 120 or permeability in the formation (FIG. 1), with the second set of isolated zones 208*a-c*. In embodiments, the isolated zones 206 and the isolated zones 208 can be characterized by different shapes, sizes, or a combination thereof, or can be the same zones of the formation 207; for example zone or interval 206*a* can be the same zone or interval as zone 208*a*. Thus, the zones or intervals 106/206 and the zones or intervals 108/208 can, in embodiments, comprise the same zone or interval of the formation 207. Alternatively, the isolated zones 206 and 208 can be similar or identical in shape or size. Each zone of the isolated zones 206 or 208 may be isolated from other zones of the isolated zones 206 or 208. In other examples the isolated zones 206 or 208 can be in fluid (and/or thermal or other suitable) communication with one another (e.g., the zones can mix and can be partially isolated). The isolated zones 206 and 208 can comprise reactive rock. As illustrated, the (e.g., open-loop) system 200 includes a first set of flow control devices 210 and a second set of flow control devices 212. The first flow control devices 210 can include flow control devices 210*a-c*, which can be positioned in the first wellbore 203 between the first isolation devices 202*a-c*. The second flow control devices 212 can include flow control devices 212*a-c*, which can be positioned in the second wellbore 205 between the second isolation devices 204*a-c*. The first set of flow control devices 210 and the second set of flow control devices 212 can include other suitable amounts of flow control devices for controlling fluid flow in the first wellbore 203 and in the second wellbore 205. In one example, the first set of flow control devices 210, the second set of flow control devices 212, or a combination thereof, can include one flow control device or a plurality of flow control devices (e.g., a flow control device 210 or 212 associated with each zone or interval 206/208 of the formation 207, respectively.

The flow control devices 210 can control fluid flow in the first wellbore 203 and between the isolation devices 202. The flow control devices 212 can control fluid flow in the second wellbore 205 and between the isolation devices 204. Additionally, the flow control devices 210 can allow for more uniform injection of fluid into the reactive rock formation 207, and the flow control devices 212 can selectively extract resulting fluid (e.g., resulting from reaction of the carbonic acid solution 145 (FIG. 1) with reactive rock of the formation 207) from the formation 207. For example, fluid/carbonic acid solution 145 can be injected into the first wellbore 203 via a tubular 214, which can be an injection path of the open-loop system 200. The carbonic acid solution 145 can be directed, by one or more of the flow control devices 210*a-c*, to a zone 206 of the first wellbore 203 characterized by a maximum reactivity with respect to the zones 206*a-c* of the first wellbore 203. The flow control device 210 associated with the zone can inject the fluid into the reactive rock formation 207 to allow a maximum or optimum amount of carbon dioxide to react with the formation 207. The resulting fluid (146 of FIG. 2) can be selectively extracted from the reactive rock formation. For example, one or more of the flow control devices 212 can allow the resulting fluid to be extracted from the formation 207 into the second wellbore 205. The flow control device(s) 212 can allow fluid of lower carbon dioxide and/or higher pH compared to other fluid that can be produced from the (e.g., other zones or intervals of the) formation 207 to be produced. For example, a pH and/or $CO_2$ concentration of the resulting fluid can be determined by the flow control device 212, by a computing device of the system 200, sensor, or by other suitable components of the system 200. Furthermore, if the pH of the fluid is above a predetermined threshold and/or a $CO_2$ concentration of the resulting fluid 146 is below a predetermined threshold, the flow control device 212 can actuate a valve (e.g., an FCD) to allow the fluid to be extracted from the formation 207. The resulting fluid 146 can be extracted from the formation 207 from any of the zones 208*a-c*, and the associated flow control device 212*a-c* can allow the resulting fluid to be extracted from the corresponding interval or zone 208 of the formation 207. The flow control device 212 can subsequently direct the fluid into a tubular 216, which can provide a return path that can allow the resulting fluid to be returned to the surface 140/produced for providing additional carbonic acid solution 145.

In embodiments, the formation 107/207/307 is a geothermal formation, and the produced fluid 146 can also be utilized for transferring absorbed geothermal energy into usable energy, for example via a heat exchanger 150 (FIG. 1). In some such embodiments, the tubular 216 can be insulated to reduce an amount of heat lost to the upper, cooler, formations. The tubular 216 may include insulating coating and an insulating fluid or solid between the tubular 216 and the casing and cement sheath that surrounds the tubular 216. In other examples, the tubular 216 may include a vacuum insulating device or process. For example, the tubular 216 may include vacuum insulated tubing (VIT), or other similar material, in examples such as when there may be a cold zone in the well. Alternatively, the flow control devices 212 can control fluid flow in the first wellbore 203 and between the isolation devices 202. In some examples, the permeability between zones 206 and zones 208 may be adequate so that second well flow control devices 212 can control fluid flow in the first wellbore 203 and between the isolation devices 204 into the second wellbore 205. The first wellbore 203 and the second wellbore 205 can be formed within a short amount of time with respect to each other (e.g., within days or weeks of each other). In other examples, the second wellbore 205 may be formed a long time (e.g., decades or longer) after the first wellbore 203. In some examples, the flow control devices 210 and 212 may use (e.g., contain or be in communication with) one or more sensors to detect the carbon dioxide concentration and/or the pH, and optionally also one or more of the temperature, pressure, flow, mineral content, pH, other suitable downhole measurements, or a combination thereof. The flow control devices 212 may additionally use (e.g., comprise or communicate with) valves positioned in the wellbores 203 and 205, respectively, for controlling the flow of the fluid. For example, the flow control devices 212 can actuate one or more valves positioned in the wellbore 205 to allow fluid to be produced from the formation based on measurements received from the sensors. The sensors used by the flow control devices 212 may not be positioned proximate to the valves. For example, the sensors may be positioned on the flow control devices 212 or on one or more locations of the tubulars 216, while the valves may be positioned adjacent to walls of the wellbores 205 or on one or more locations of the tubular 216 that are different than the one or more locations of the sensors.

Figure 3:
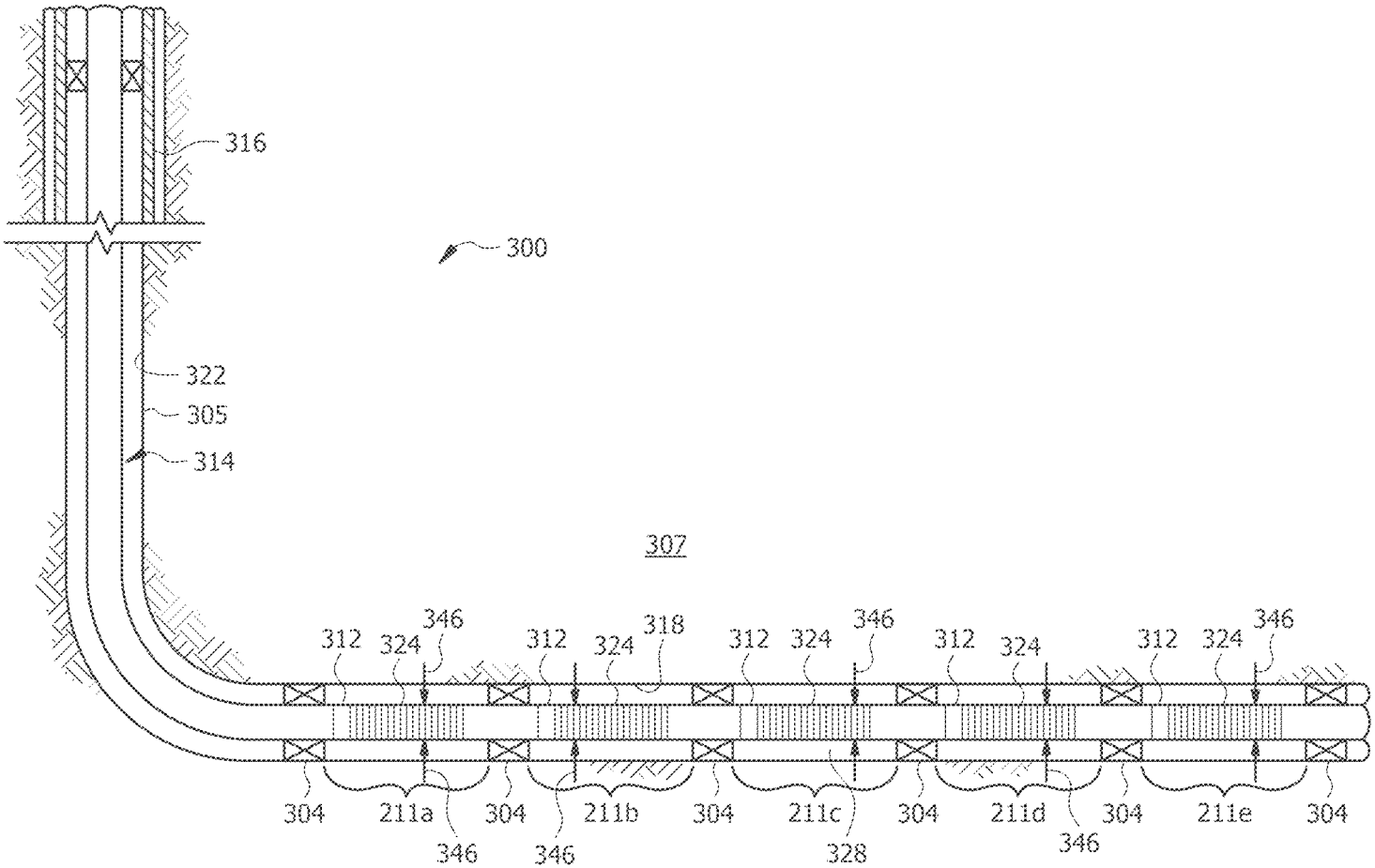
FIG. 3 is a detailed schematic of a wellbore suitable for use in a carbon dioxide sequestration system of this disclosure.

FIG. 3 is a detailed schematic of a wellbore 300 that can be utilized as the first or injection well 103/203, the production well 105/205, or both. Although depicted as a production well, a similar arrangement can be utilized as an injection well 103/203. As depicted in FIG. 3, a wellbore 312 has a generally vertical uncased section 322 extending downwardly from casing 316, as well as a generally horizontal uncased section 318 extending through an earth formation 307.

A tubular string 314 (such as a production tubing string) is installed in the wellbore 312. Interconnected in the tubular string 314 can be multiple well screens 324, variable flow resistance systems 312, and packers 304. The packers 304 seal off an annulus 328 formed radially between the tubular string 314 and the wellbore section 318. In this manner, fluids 346 may be produced from multiple intervals or zones of the formation 307 via isolated portions of the annulus 328 between adjacent pairs of the packers 304.

Positioned between each adjacent pair of the packers 304, a well screen 324 and a flow control device (e.g., a variable flow resistance system or a fixed flow system) 312 can be interconnected in the tubular string 314. The well screen 324 filters the (e.g., resulting) fluids 346 flowing into the tubular string 314 from the annulus 328. The FCD 312 variably restricts flow of the fluids 346 into the tubular string 314, based on certain characteristics of the fluids.

At this point, it should be noted that the well system 300 is illustrated in the drawings and is described herein as merely one example of a wide variety of well systems in which the principles of this disclosure can be utilized. It should be clearly understood that the principles of this disclosure are not limited at all to any of the details of the well system 300, or components thereof, depicted in the drawings or described herein.

For example, it is not necessary in keeping with the principles of this disclosure for the wellbore 312 to include a generally vertical wellbore section 322 or a generally horizontal wellbore section 318, as a wellbore section may be oriented in any direction, and may be cased or uncased, without departing from the scope of the present disclosure. It is not necessary for fluids 346 to be only produced from the formation 307 as, in other examples, additional fluids could be injected into a formation, such as injected through the tubular string 314 and out into the formation 307, or fluids could be both injected into and produced from a formation, etc. Further, it is not necessary for one each of the well screen 324 and FCD 312 to be positioned between each adjacent pair of the packers 304. It is not necessary for a single FCD 312 to be used in conjunction with a single well screen 324. Any number, arrangement and/or combination of these components may be used.

It is not necessary for any FCD 304 to be used with a well screen 324. For example, in injection operations, the injected fluid could flow through an FCD 304, without also flowing through a well screen 324.

It is not necessary for the well screens 324, FCDs 312, packers 304 or any other components of the tubular string 314 to be positioned in uncased sections 322, 318 of the wellbore 312. Any section of the wellbore 312 may be cased or uncased, and any portion of the tubular string 314 may be positioned in an uncased or cased section of the wellbore, in keeping with the principles of this disclosure.

It should be clearly understood, therefore, that this disclosure describes how to make and use certain examples, but the principles of the disclosure are not limited to any details of those examples. Instead, those principles can be applied to a variety of other examples using the knowledge obtained from this disclosure.

It will be appreciated by those skilled in the art that it would be beneficial to be able to regulate flow of the fluids 346 into the tubular string 314 from each zone of the formation 307 to maximize the carbonate formation reaction, and/or to be able to regulate flow of the fluids 346 out of the tubular string 314 into each zone of the formation 307. Other uses for flow regulation in a well include, but are not limited to, balancing production from (or injection into) multiple zones, minimizing production of undesired fluids, maximizing production or injection of desired fluids, etc.

In embodiments, FCD 312 comprise an electronic flow resistance system 312, as described more fully below, that can provide benefits by adjusting the resistance of fluid flow based on the pH and/or carbon dioxide concentration of the fluid. The electronic flow control device utilizes sensors to detect the changes in the pH or carbon dioxide concentration in order to make these flow resistance adjustments.

Referring back to FIG. 1, in embodiments, for each of the one or more first wells 103, each flow control device 110 thereof configured to control the flow rate of the solution comprising carbonic acid 145 into the one of the plurality of zones or intervals 106 of the formation 107 is positioned in one of the isolated portions 109 of said each first well 103;

wherein, for each of the one or more second (e.g., production) wells 105, each flow control device 112 thereof configured to control the flow rate of the resulting solution 146 from the one of the plurality of zones or intervals 108 of the formation 107 into the one of the second (producing) wells 105 is positioned in one of the isolated portions 111 of said one second well 105; or a combination thereof.

The first well flow control devices 110/210 can comprise passive flow control devices, the second well flow control devices 112/212/312 can comprise electronic flow control devices, or both the first well flow control devices 110/210 and the second well flow control devices 112/212/312 can comprise fixed and/or electronic flow control devices, such as described hereinbelow. For example, in embodiments the second well flow control devices 112/212/312 comprise electronic flow rate flow control devices. In embodiments, the first well flow control devices 110/210 comprise fixed (e.g., non-adjustable flow rate) flow control devices.

A system of this disclosure can further comprise, associated with each of the second well flow control devices 112/212/312, a sensor (e.g., sensor 442 of FIG. 4 described further hereinbelow) for measuring a property (e.g., pH and/or $CO_2$ concentration) of the resulting solution 146/346 passing therethrough; and a controller 160 operable for adjusting a flow rate of the pump 130, a flow rate of the solution comprising carbonic acid 145 flowing from the one or more injection wells 103 into one or more of (e.g., each of) the plurality of zones or intervals 106 of the formation 107 via the first well flow control devices 110, a flow rate of the resulting solution 146 flowing from one or more of (e.g., each of) the plurality of zones or intervals 108 to the one or more production wells 105 via the second well flow control devices 112, or a combination thereof based on the property. The controller 160 can be above ground or downhole (e.g., above or below surface 140. The property can comprise pH, carbon dioxide concentration, or both. The controller 160 can be configured to adjust a flow rate (e.g., a flow rate of the pump 130, a flow rate of the solution comprising carbonic acid 145 flowing from the one or more injection wells 103 into one or more of (e.g., each of) the plurality of zones or intervals 106 of the formation 107 via the first well flow control devices 110, a flow rate of the resulting solution 146 flowing from one or more of (e.g., each of) the plurality of zones or intervals 108 to the one or more production wells 105 via the second well flow control devices 112, or a combination thereof) based on a difference between a pH of the carbonic acid solution 145 pumped into the plurality of zones or intervals 106 via the one or more first wells 103 and a pH of the resulting solution 146 received in one of the isolated portions 111 of a second well 105. In embodiments, the flow rate can be adjusted based on a difference between a pH of the carbonic acid solution (e.g., carbonic acid solution 145/145A/145B/145C and so on), as measured, for example, by a sensor (e.g., 442, FIG. 4) optionally associated with a first well flow control device (e.g., 110A/110B/110C), being pumped into one of the plurality of zones or intervals (e.g., 106A/106B/106C and so on) via the one or more first wells 103 and a pH of the resulting solution 146A/146B/146C), as measured, for example, by a sensor (e.g., 442, FIG. 4) associated with a second well flow control device (e.g., 112A/112B/112C), being received from one of the isolated portions 111A/111B/111C of a second wellbore 105.

Thus, in embodiments, the variable flow control devices (e.g., electronic ICDs (eICDs)) can each have an associated sensor, and, using the data from the sensor, the variable flow control device can adjust its flow rate restriction based on the data from its associated sensor. In embodiments, the injection controller can also receive data from the variable flow control devices and also adjust injection rates, for example, if data is transmitted from the variable flow control devices to the surface.

The use of the downhole flow control devices and associated (e.g., carbon dioxide and/or pH) sensors can thus, in embodiments, enable substantially real time monitoring of the extent of the carbonate formation reaction (e.g., the reaction of the carbonic acid with the reactive rock to produce solid carbonate), and allow the carbonic acid solution 145 to be circulated through the formation in a manner that improves/maximizes a rate and/or extent of $CO_2$ sequestration. The FCD's can be operable to, substantially real time, adjust a flow rate (and thereby pathway of flow) of the carbonic acid solution to the formation 107/207/307 and/or a flow rate (and thereby pathway of flow) of the resulting (e.g., recovered) solution (e.g., 146/146A/146B/146C) entering the second wellbore from the formation 107/207/307 based on the sensed property(ies) (e.g., carbon dioxide concentration and/or pH of the fluid being sensed therewith). A processor or controller can be operable to obtain property values sensed via the sensor (e.g., 442 FIG. 4), such as pH and/or carbon dioxide concentration) and utilize the sensed values to determine whether to increase or decrease fluid flow through the FCD to or from a specific zone or interval of the formation. The controller can, for example, compare the sensed value to a threshold value, can calculate a difference in the sensed property from a prior reading or a reading elsewhere (e.g., in another interval or zone of the formation) to determine if and by how much to adjust the flow rate through the FCD. The controller or processor can be proximate the FCD or distal therefrom (e.g., a controller 160 located above the surface and/or controller and electronics 446 associated with an FCD as described with reference to FIG. 4)). For example, if the sensed pH of resulting fluid 146X from a zone or interval of the formation 107 is above a (e.g., upper) threshold value (e.g., a pH of greater than or equal to about 4.8, 5.0, 5.2, 5.4, 5.6, 5.8, 6, 7, 8, or in a range thereamong), indicating that the reactive rock is reacting with the carbonic acid solution, a flow rate can be increased through that zone or interval, whereas if the sensed pH of resulting fluid 146X from a zone or interval of the formation 107 is below a (e.g., lower) threshold value (e.g., a pH of less than or equal to about 4.8, 4.6, 4.4, 4.2, 4.0, 3.8 or in a range thereamong), indicating that the reactive rock is not effectively reacting with (or having time to react with) the carbonic acid solution, a flow rate can be decreased through that zone or interval to allow further time for reaction and/or direct the fresh carbonic acid solution to zones or intervals of the formation which are exhibiting effective formation of carbonate. By way of further example, if the sensed $CO_2$ concentration of resulting fluid 146X from a zone or interval of the formation 107 is below a (e.g., lower) threshold value (e.g., a sensed $CO_2$ concentration of less than or equal to about 0.010, 0.015, 0.020, 0.025 lb $CO_2$/lb water or in a range thereamong), indicating that the reactive rock is efficiently reacting with (and/or having time to react with) the carbonic acid solution, a flow rate can be increased through that zone or interval, whereas if the sensed $CO_2$ concentration of resulting fluid 146X from a zone or interval of the formation 107 is above a (e.g., upper) threshold value (e.g., a sensed $CO_2$ concentration of greater than or equal to about 0.03, 0.04, 0.05, 0.06, 0.07, 0.08, or 0.09 lb $CO_2$/lb water or in a range thereamong), indicating that the reactive rock is not effectively reacting therewith, a flow rate can be decreased through that zone or interval to allow further time for reaction and/or direct the fresh carbonic acid solution to zones or intervals of the formation which are exhibiting effective formation of carbonate. The pH of the carbonic acid solution 145 (e.g., 145*a*, 145*b*, 145*c*, and so on) can be less than about 3.7, 4.0, or 4.5, or can be in a range of from about 3.6 to about 4.8, from about 3, to about 5; the pH of the resulting solution 146 (e.g., 146*a*, 146*b*, 146*c*, and so on) can be maintained (when effective carbonate formation reaction is occurring) at greater than or equal to about 4.0, 4.5, or 5, or can be maintained (when effective carbonate formation reaction is occurring) in a range of from about 4.5 to about 5, from about 4.0, to about 8. The $CO_2$ concentration of the carbonic acid solution 145 (e.g., 145*a*, 145*b*, 145*c*, and so on) can be greater than about 0.03 lb $CO_2$ per lb of water, 0.04 lb $CO_2$ per lb of water or 0.05 lb $CO_2$ per lb of water or can be in a range of from about 0.03 lb $CO_2$ per lb of water to about 0.07 lb $CO_2$ per lb of water from about 0.02 lb $CO_2$ per lb of water, to about 0.09 lb $CO_2$ per lb of water; the $CO_2$ concentration of the resulting solution 146 (e.g., 146*a*, 146*b*, 146*c*, and so on) can be maintained (when effective carbonate formation reaction is occurring) at less than or equal to about 0.015 lb $CO_2$ per lb of water, 0.02 lb $CO_2$ per lb of water, or 0.025 lb $CO_2$ per lb of water, or can be maintained (when effective carbonate formation reaction is occurring) in a range of from about 0.015 lb $CO_2$ per lb of water to about 0.035 lb $CO_2$ per lb of water, from about 0.01 lb $CO_2$ per lb of water to about 0.05 lb $CO_2$ per lb of water.

Accordingly, in embodiments, difference in a pH of the carbonic acid solution 145 (e.g., 145*a*, 145*b*, 145*c*, and so on) and a pH of the resulting solution 146 (e.g., 146*a*, 146*b*, 146*c*, and so on) can be maintained (when effective carbonate formation reaction is occurring) at greater than or equal to about 50%, 75%, or 90%, or can be maintained (when effective carbonate formation reaction is occurring) in a range of from about 50% to about 75%, from about 30%, to about 100%, or from about 30%, to about 80%. In embodiments, the pH of the resulting solution 146 (e.g., 146*a*, 146*b*, 146*c*, and so on) can be maintained (when effective carbonate formation reaction is occurring) at about 50, 55, 60, 65, 70, 75, 80, 85, or 90 percent of the pH of the carbonic acid solution 145 (e.g., 145*a*, 145*b*, 145*c*, and so on). A difference in a $CO_2$ concentration of the carbonic acid solution 145 (e.g., 145*a*, 145*b*, 145*c*, and so on) and a $CO_2$ concentration of the resulting solution 146 (e.g., 146*a*, 146*b*, 146*c*, and so on) can be maintained (when effective carbonate formation reaction is occurring) at greater than or equal to about 50, 55, 60, 65, 70, 75, 80, 85, or 90% or can be maintained (when effective carbonate formation reaction is occurring) in a range of from about 50 to about 90, from about 75, to about 90, or from about 50 to about 95%. In embodiments, the $CO_2$ concentration of the carbonic acid solution 145 (e.g., 145*a*, 145*b*, 145*c*, and so on) can be maintained (when effective carbonate formation reaction is occurring) at about 50, 55, 60, 65, 70, 75, 80, 85, or 90 percent of the $CO_2$ concentration of the resulting solution 146 (e.g., 146*a*, 146*b*, 146*c*, and so on).

The sensors utilized to determine the property can be proximate (e.g., a component of) an FCD (e.g., sensor 446 described hereinbelow with reference to FIG. 4), or can be positioned away from the FCD with which it is associated. Any sensors operable to determine pH and/or $CO_2$ concentration can be utilized. By way of nonlimiting example, the sensor (e.g., 446, FIG. 4) associated with one or more (e.g., each) of the first well flow control devices 110/210, the second well flow control devices 112/212/312, or both can comprise a Severinghaus electrode configured to measure $CO_2$ concentration.

The controller 160 (or a controller and electronics 446 of the FCD, described hereinbelow with reference to FIG. 4 can be configured to increase a flow rate or the solution comprising carbonic acid 145 into zones or intervals 108 from which the resulting solution 146 has an elevated pH and/or a reduced carbon dioxide concentration relative to a pH and/or carbon dioxide concentration, respectively, of the carbonic acid solution 145 pumped thereto. It is noted that the sensor associated with a variable flow control device (e.g., an eICD) can determine if that variable flow control device needs to adjust its flow rate based on the measured pH or $CO_2$ level at that variable flow control device.

As noted above, in embodiments, the system of this disclosure can further include a heat exchanger 150 configured to extract heat from the resulting fluid 146 produced from second or production well(s) 105 (e.g., for geothermal applications).

The system 100 of this disclosure can further comprise a flow line 180 extending from first wellbore 103 to second wellbore 105, whereby pumping can be reversed such that the solution of carbonic acid 145 can be pumped into the one of the second wells 105/205/305 and resulting solution 146 can be removed/produced from the one of the first wells 103/203 to increase a total amount of carbon dioxide sequestered in the formation 107/207/307.

A method of this disclosure can comprise: pumping, via each of one or more first (e.g., injection) wells 103/203/303, a solution comprising carbonic acid 145 produced via contact of carbon dioxide 99 and water 101/produced solution 146 into each of a plurality of zones intervals 106/206 of a formation 107/207/307, wherein the carbonic acid solution 145 flows via the each of the plurality of zones or intervals 106/206 of the formation 107/207/307 into one or more producing wells 105/205/305 via fractures 120 in the plurality of zones or intervals 106/206, and wherein the carbonic acid solution 145 reacts with reactive rock in the plurality of zones or intervals 106/206/108/208 of the formation 107/207/307 to produce a solid (e.g., carbonate) and a resulting solution 146/346, wherein the resulting solution 146/346 has a higher pH than a pH of the solution comprising carbonic acid 145; and producing, via one or more second (e.g., production) wells 105/205/305, the resulting solution 146/346 that flows into the one or more production wells 105/205/305 via the plurality of intervals 106/108/206/208; and monitoring, via a sensor (e.g., 442 of FIG. 4, described further hereinbelow), a property (e.g., pH and/or $CO_2$ concentration) of the resulting solution 146/346; and adjusting a flow rate of the pumping, a flow rate of the solution comprising carbonic acid 145 flowing from the one or more injection wells 103/203/303 into one or more of (e.g., each of) the plurality of zones or intervals of the formation 107/207/307, a flow rate of the resulting solution 146/346 flowing from one or more of (e.g., each of) the plurality of zones or intervals 108/208 to the one or more production wells 105/205/305, or a combination thereof based on the property.

Each of the one or more first (e.g., injection) wells 103/203 further comprise flow control devices 110/210, each of the flow control devices 110/210 configured to control a flow rate of the solution comprising carbonic acid 145 into one of the plurality of zones or intervals of the formation 107/207/307, wherein the one or more second (e.g., production) wells 105/205/305 further comprise flow control devices 112/212/312, each of the flow control devices 112/

212/312 configured to control the flow rate of the resulting solution 146/346 from one of the plurality of zones or intervals of the formation 107/207/307 into one of the second (producing) wells 105/205/305, or a combination thereof. The flow control devices 110/210 of the one or more first (e.g., injection) wells 103/203, the flow control devices 112/212/312 of the of the one or more second (e.g., producing) wells 105/205/305, or both can comprise adjustable flow control devices. Each of the one or more first (e.g., injection) wells 103/203 can be divided into isolated portions 109 via (and between adjacent pairs of) packers or other isolation devices 102, wherein each of the isolated portions 109 of said each first well 103/203 can be configured for pumping of the solution of carbonic acid 145 into one of the plurality of zones or intervals 106/206 of the formation 107/207/307, wherein each of the one or more second (e.g., production) wells 105/205/305 can be divided into isolated portions 111/211/311 via (and between) adjacent pairs of packers or other isolation devices 104, wherein each of the isolated portions 111/211/311 of said each second well 105/205/305 can be configured for receiving the resulting solution 146/346 from one of the plurality of zones or intervals (e.g., 108/208) of the formation 107/207/307, or a combination thereof.

For each of the one or more first wells 103/203, each flow control device 110/210 thereof configured to control the flow rate of the solution comprising carbonic acid 145 into the one of the plurality of zones or intervals 106 of the formation 107 can be positioned in one of the isolated portions 109/209 of said each first well 103/203; wherein, for each of the one or more second (e.g., production) wells 105/205/305, each flow control device 112/212/312 thereof configured to control the flow rate of the resulting solution 146/346 from the one of the plurality of zones or intervals 108 of the formation 107/207/307 into the one of the second (producing) wells 105/205/305 can be positioned in one of the isolated portions 111/211/311 of said one second well 105/205/305; or a combination thereof.

The method can further comprise increasing or decreasing a flow rate of the solution comprising carbonic acid 145 into one or more of the plurality of zones or intervals based on the sensed property, for example, increasing or decreasing a flow rate of the solution comprising carbonic acid 145 into one or more of the plurality of zones or intervals when the property of the resulting solution 146/346 exceeds (e.g., is greater than or less than) a threshold value. The property can comprise a pH of the resulting solution, a $CO_2$ concentration of the resulting solution 146/346, a difference in pH of the carbonic acid solution 145 and the resulting solution 146, a difference in the carbon dioxide concentration of the carbonic acid solution 145 and the resulting solution 146, or a combination thereof. The increasing can be effected autonomously (e.g., by the FCDs) or can be effected from the surface 140/240 based on the monitored property.

The method can further comprise: fracturing the formation 107/207/307 prior to first pumping the solution comprising carbonic acid 145 into the plurality of zones or intervals thereof; fracturing the formation 107/207/307 subsequent pumping the solution comprising carbonic acid 145 into the plurality of zones or intervals thereof for a time period; or both fracturing the formation 107/207/307 prior to first pumping the solution comprising carbonic acid 145 into the plurality of zones or intervals thereof and re-fracturing the formation 107/207/307 subsequent pumping the solution comprising carbonic acid 145 into the plurality of zones or intervals thereof for the time period. The method of this disclosure can further comprise: after a period of time, reversing flow direction by pumping the solution comprising carbonic acid 145 via the one or more second (previously producing) wells 105/205/305, and producing the resulting solution 146 via the one or more first (e.g., previously injection) wells 103/203.

The formation 107/207/307 comprises reactive rock. The reactive rock can be selected from mafic rocks, ultramafic rocks and minerals and/or fragments thereof. The mafic rock can comprise a silicate mineral or igneous rock that is rich in magnesium, calcium, and/or iron. The mafic rock can comprise mafic minerals selected from olivine, pyroxene, amphibole, and biotite. The reactive rock can comprise mafic rock selected from basalt, diabase, and gabbro, ultramafic rock selected from dunnite, peridotite, and/or pyroxenite, or a combination thereof. In embodiments, as noted above, the formation 107/207/307 comprises a geothermal formation. In some such embodiments, the method of this disclosure can further comprise utilizing heat of the resulting solution 146/346 produced to the surface 140/240/340, for example in a geothermal application.

The method of this disclosure can further comprise: combining carbon dioxide 99 with water 101 (and optionally, after startup, the produced solution 146) to provide the solution comprising carbonic acid 145 at or disparate from a location at which the pumping (e.g., via pump 130) is effected; and/or combining carbon dioxide 99 with water 101 (and optionally, after startup, the produced solution 146) prior to introducing the solution comprising carbonic acid 145 into the one or more first (e.g., injection) wells 103/203/303; introducing carbon dioxide 99 and water 101 (and optionally, after startup, the produced solution 146) separately into each of the one or more injection wells 103/203, wherein the solution comprising carbonic acid 145 is formed therein; or a combination thereof.

Also provided herein is a method comprising: pumping a solution comprising carbonic acid 145 produced via contact of carbon dioxide 99 and water 101 (and optionally, after startup, the produced solution 146) into each of a plurality of zones intervals of a formation 107/207/307, wherein the carbonic acid solution 145 flows via the each of the plurality of zones or intervals of the formation 107/207/307 via fractures 120 in the plurality of zones or intervals, and wherein the carbonic acid solution 145 reacts with reactive rock in the plurality of zones or intervals of the formation 107/207/307 to produce a solid (e.g., carbonate) and a resulting solution 146/346, wherein the resulting solution 146/346 has a higher pH than a pH of the solution comprising carbonic acid 145 (e.g., comprises less carbon dioxide); and producing the resulting solution 146/346 from the formation 107/207/307; and monitoring a property (e.g., pH and/or $CO_2$ concentration) of the resulting solution 146/346; and adjusting a flow rate of the pumping, a flow rate of the solution comprising carbonic acid 145 being pumped into one or more of (e.g., each of) the plurality of zones or intervals of the formation 107/207/307, a flow rate of the resulting solution 146/346 being produced from one or more of (e.g., each of) the plurality of zones or intervals of the formation 107/207/307, or a combination thereof based on the property. As noted hereinabove, the property can comprise a pH, a carbon dioxide concentration, or a combination thereof. Adjusting a flow rate based on the property can comprise adjusting a flow rate based on a difference between the property of the resulting solution 146/346 and a pH of the solution comprising carbonic acid 145 being pumped (e.g., via pump(s) 130). The method can further comprise fracturing the formation 107/207/307 in the one or more zones or intervals of the formation 107/207/307 prior to and/or subsequent the pumping of the solution comprising carbonic acid 145 for a duration of time. The method can further comprise, after a time period, reversing the pumping of the solution comprising carbonic acid 145 such that the flow through the one or more zones or intervals of the formation 107/207/307 between the first or injection well(s) 103/203 and the second or production well(s) 105/205/305 is substantially reversed.

As noted hereinabove, in embodiments, one or more of the first well flow control devices 110/210, one or more of the second well flow control devices 112/212/312, or both one or more of the first well flow control devices 110/210 and one or more of the second well flow control devices 112/212/312 comprise a variable flow control device. The variable flow well control device can be an electrically actuatable flow control device (e.g., an eICD) operable to adjust the flow rate of a downhole fluid (e.g., carbonic acid solution 145 or resulting fluid 146) based on a pH and/or carbon dioxide concentration thereof determined by a sensor proximate or positioned away from the flow control device. Any variable flow control device can be utilized. In embodiments, the variable flow control device comprises a variable flow resistance system as described in U.S. Pat. No. 11,105,183, the disclosure of which is hereby incorporated herein for purposes not contrary to this disclosure.

Figure 4:
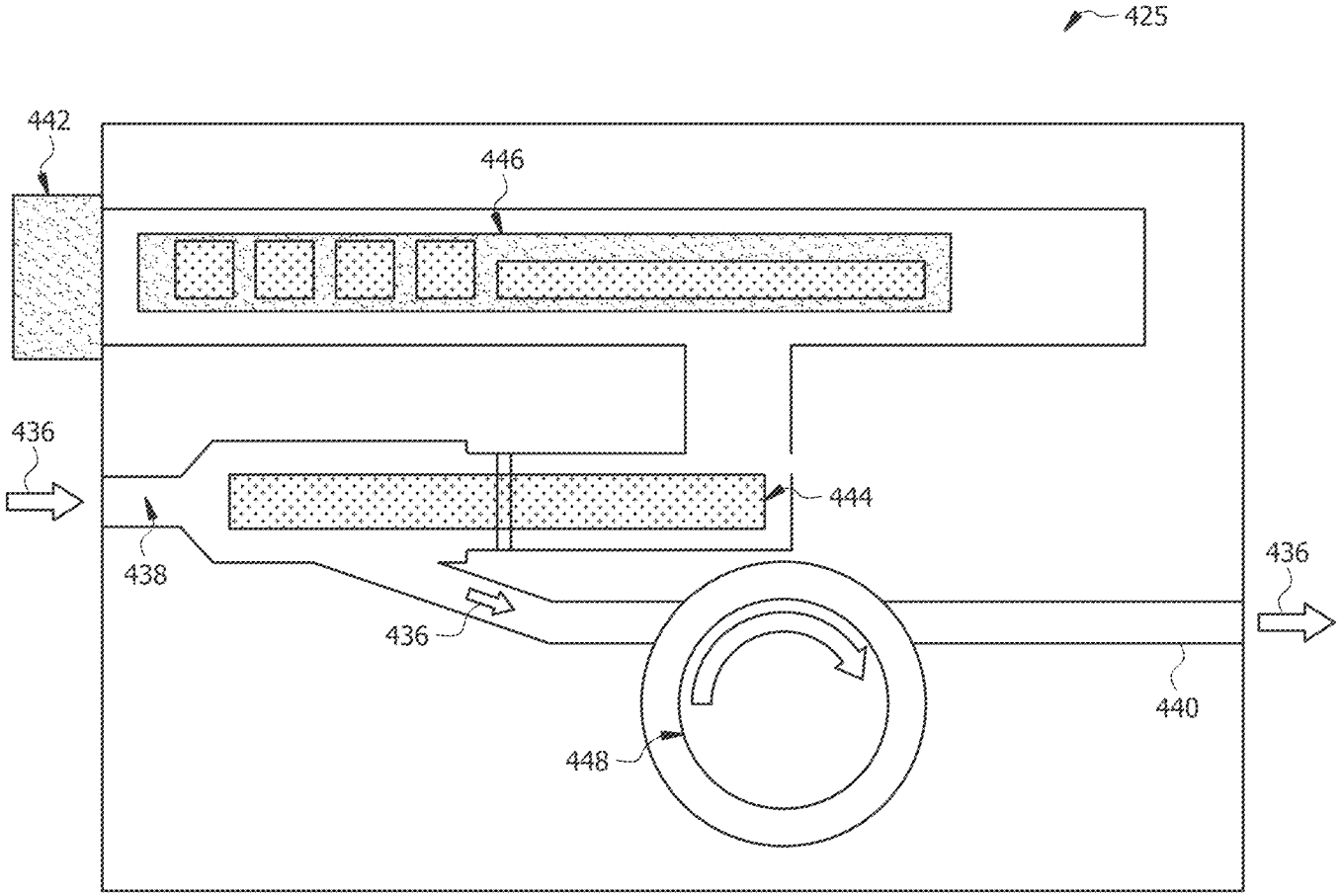
FIG. 4 is a schematic view of a variable flow device in accordance with one or more embodiments of the present disclosure.

FIG. 4 depicts a schematic view of a variable flow resistance system 425 that can be used as the variable FCD, in embodiments of this disclosure. In this example, a fluid 436 (which can include carbonic acid solution 145 or produced or resulting solution 146) can be filtered by a well screen (324 in FIG. 3), and/or may flow into a first flow path 438 (e.g., an inlet flow path) of the variable flow resistance system 425. A fluid can include one or more undesired or desired fluids. Both steam and water can be combined in a fluid. As another example, oil, water and/or gas can be combined in a fluid, as such components can be introduced into the carbon acid solution 145 downhole. Flow of the fluid 436 through the variable flow resistance system 425 can be resisted to control a flow rate of the fluid flowing through the system 425. The fluid 436 may then be discharged from the variable flow resistance system 425, such as to an interior or exterior of the tubular string 314 (FIG. 3) via a second flow path 440 (e.g., an outlet flow path). As used herein, the first flow path 438 and the second flow path 440 may be generally described and function as an inlet flow path and an outlet flow path, respectively. However, the present disclosure is not so limited, as the flow of the fluid 436 may be reversed, such as during injection applications, through the variable flow resistance system 425 such that the first flow path 438 and the second flow path 440 may be generally described and function as an outlet flow path and an inlet flow path, respectively.

In other examples, the well screen 424 may not be used in conjunction with the variable flow resistance system 425 (e.g., in injection operations), the fluid 436 could flow in an opposite direction through the various elements of the well system 100/200/300 (e.g., in injection operations), a single variable flow resistance system could be used in conjunction with multiple well screens, multiple variable flow resistance systems could be used with one or more well screens, the fluid could be received from or discharged into regions of a well other than an annulus or a tubular string, the fluid could flow through the variable flow resistance system prior to flowing through the well screen, any other components could be interconnected upstream or downstream of the well screen and/or variable flow resistance system, etc. Thus, it will be appreciated that the principles of this disclosure are not limited at all to the details of the example depicted in the figures and described herein. Further, additional components (such as shrouds, shunt tubes, lines, instrumentation, sensors, inflow control devices, etc.) may also be used in accordance with the present disclosure, if desired.

The variable flow resistance system 425 is depicted in simplified form in FIG. 4, but in embodiments, the system 425 can include various passages and devices for performing various functions, as described more fully below. In addition, the system 425 can at least partially extend circumferentially about the tubular string 314, or the system 425 may be formed in a wall of a tubular structure interconnected as part of the tubular string.

In other examples, the system 425 may not extend circumferentially about a tubular string or be formed in a wall of a tubular structure. For example, the system 425 could be formed in a flat structure, etc. The system 425 could be in a separate housing that is attached to the tubular string 314, or it could be oriented so that the axis of the second flow path 440 is parallel to the axis of the tubular string. The system 425 could be on a logging string, production string, drilling string, coiled tubing, or other tubular string or attached to a device that is not tubular in shape. Any orientation or configuration of the system 425 may be used in keeping with the principles of this disclosure.

Referring now back to FIG. 4, the variable flow resistance system 425 includes the first flow path 438 to receive fluid into the system 425 and a second flow path 440 to send fluid out of the system 425. When fluid exits the system 425, the fluid may, for example, enter into the interior of a tool body or out of the exterior of a tool body used in conjunction with the variable flow resistance system 425. The variable flow resistance system 425 may further include a sensor 442 and an actuator 444. The sensor 442 can be included to measure one or more properties or characteristics of the fluid received into the system 425, such as measure the pH, carbon dioxide concentration, and/or flow rate of the fluid received into the system 425. Though not so limited, and as discussed below, the sensor 442 may be positioned near or within the first flow path 438 to measure the property or characteristic of the fluid received into the system 425 through the first flow path 438.

The actuator 444 may control or adjust an inflow rate of fluid received into the system 425 and the first flow path 438. Additionally or alternatively, the actuator 444 may control or adjust the restriction of fluid inflow received into the system 425 and the first flow path 438 and/or control or adjust a drop in pressure between first flow path 438 and second flow path 440. For example, the actuator 444 may be positioned or included within the system 425 to extend into and retract from the fluid flow path extending and formed through the system 425. To increase the inflow rate of the fluid, or decrease the inflow fluid restriction or pressure drop across the system 425, the actuator 444 may retract to enable more fluid to flow through the fluid flow path of the system 425. To decrease the inflow rate of the fluid, or increase the inflow fluid restriction or pressure drop across the system 425, the actuator 444 may extend to restrict the fluid flow through the fluid flow path of the system 425. Further, in one or more embodiments, the actuator 444 may be used to fully stop or inhibit the fluid flow through the fluid flow path of the system 425. For example, if the system 425 is turned or powered off, the actuator 444 may fully extend to prevent fluid flow through the fluid flow path of the system 425. Accordingly, the actuator 444 may be used as or include an adjustable valve to be in a fully open position, a fully closed position, or an intermediate position to control the flow rate of fluid through the system 425. Further, in one or more embodiments, the control or adjustment of the inflow rate of fluid, the restriction of fluid inflow, or the pressure drop may all be parameters related to each other. Accordingly, as used herein, when referring to control or adjustment of one parameter, such as the inflow rate of fluid, may also be referring to control or adjustment of another parameter without departing from the scope of the present disclosure.

The actuator 444 may include a mechanical actuator (e.g., a screw assembly), an electrical actuator (e.g., piezoelectric actuator, electric motor), a hydraulic actuator (e.g., hydraulic cylinder and pump, hydraulic pump), a pneumatic actuator, and/or any other type of actuator known in the art. For example, the actuator 444 may include a linear or axially driven actuator, in which the actuator 444 interacts with an orifice included in the first flow path 438 to operate as an adjustable valve and control the inflow rate of the fluid.

Referring still to FIG. 4, the variable flow resistance system 425 can include one or more power sources. For example, the system 425 can include a power generator 448 and/or a power storage device. The power generator 448 may be used to generate power for the system 425, and the power storage device may be used to provide stored power for the system 425 and/or store power generated by the power generator 448. In one embodiment, the power generator 448 can include a turbine and may be able to generate power from fluid received into the first flow path 438 and flowing through the system 425. The power generator 448 can additionally or alternatively include other types of power generators, such as a flow induced vibration power generator and/or a piezoelectric generator, to generate power from the fluid received into the system 425 and/or from other energy sources present downhole (e.g., temperature and/or pressure sources).

The power storage device may be included within electronics 446 for the system 425 and may be used to provide stored power. In one embodiment, the power storage device may be able to store power generated by the power generator 448 and provide this stored powered for the system 425. The power storage device may include a capacitor (e.g., super capacitor), battery (e.g., rechargeable battery), and/or any other type of power storage device known in the art. In one or more embodiments, as the sensor(s) and/or actuator(s) of the system 425 may require more power than generated by the power generator 448, the power storage device may be used to store power, and then supplement the power generator 448 when running the sensor(s), actuator(s), and/or other components of the system 425.

As discussed above, the system 425, and more particularly the actuator 444, can be used to control or adjust an inflow rate of fluid received into the system 425 through the first flow path 438, control or adjust the restriction of fluid inflow received into the system 425, and/or control or adjust a drop in pressure across the system 425. The inflow rate of the fluid received into the system 425 can be controlled based upon a control signal received by the system 425. A control signal may be sent to the system 425 from a transmitter, such as a transmitter uphole or upstream of the system 425, or even on or close to the surface of the well. The control signal may be sent to the system 425 through the flow rate of the fluid, and more particularly by selectively fluctuating and varying the flow rate of the fluid received by the system 425. A profile or pattern of flow rate fluctuations may be used to indicate a unique control signal, such as with communications involving flow rate telemetry. Accordingly, a transmitter, controlling the flow rate of the fluid, may be able to encode one or more control signals through flow rate fluctuations of the fluid, and a receiver, measuring the flow rate of the fluid, may be able to decode one or more controls signals through the flow rate fluctuations of the fluid.

The transmitter is able to transmit a control signal by generating flow rate fluctuations of the fluid uphole or downstream of the system 425. Accordingly, to generate the flow rate fluctuations, the transmitter may include or control a choke, a bypass around a choke, a valve, a pump, or control the backpressure of the fluid at the surface, thereby selectively generating fluctuations in the flow rate of the fluid into and out of the system 425.

The receiver may be able to receive a control signal by measuring flow rate fluctuations of the fluid at the system 425. The receiver may include or be coupled to a carbon dioxide sensor, a pH sensor, and/or a flow rate sensor or flow meter that is able to measure a $CO_2$ concentration, a pH, and/or flow rate of the fluid, respectively, received into the system 425. For example, with respect to FIG. 4, the sensor 442 may be used to measure the flow rate of the fluid received into the flow path 438. An example of a flow rate sensor 442 may include an accelerometer or a hydrophone that may be able to measure a flow rate of fluid flow, or a differential pressure gauge positioned across the system 425 to detect a flow rate through the system 425.

Figure 5:
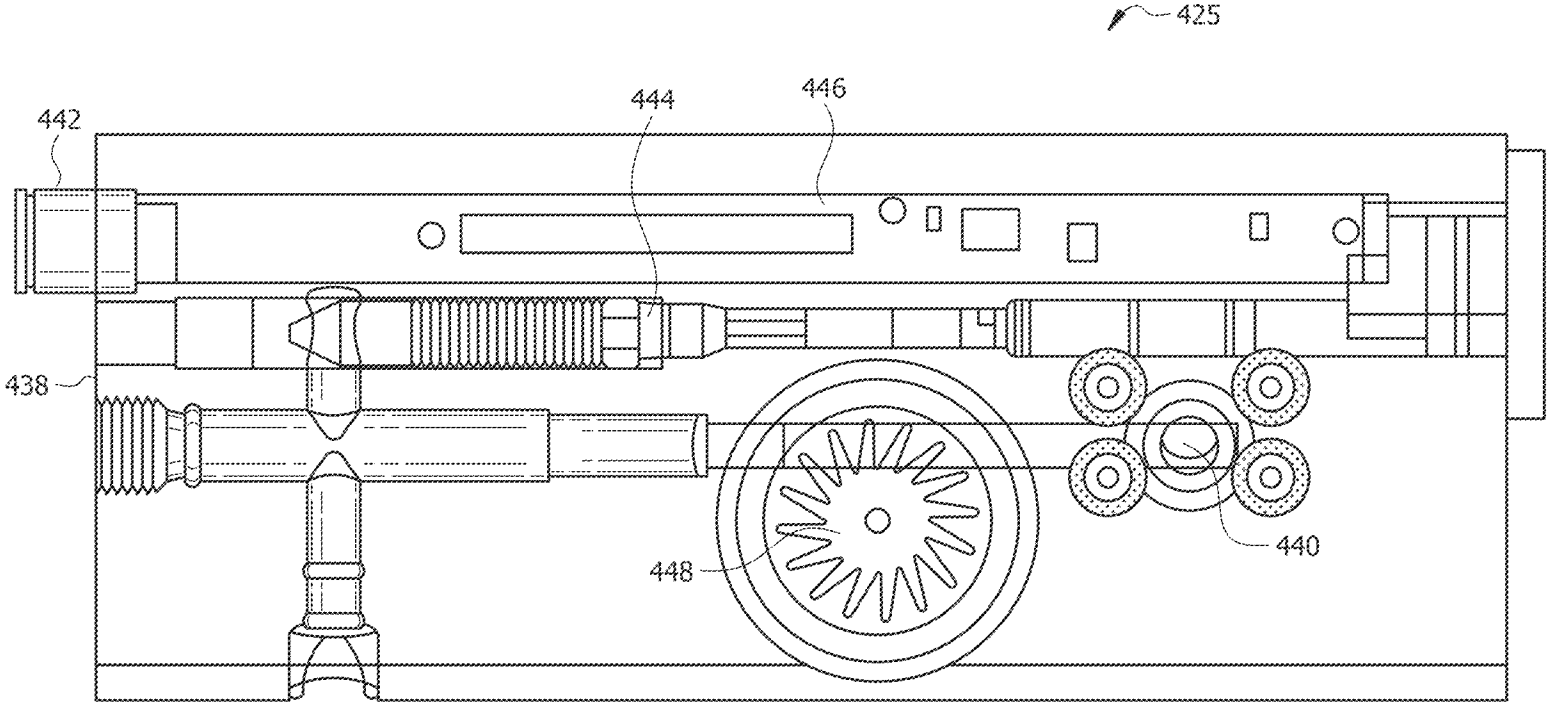
FIG. 5 is a detailed view of a variable flow resistance system, according to embodiments of the present disclosure.

Additionally or alternatively, the power generator 448 may be used as the flow rate sensor. For example, FIG. 5 shows a detailed view of a variable flow resistance system 425 in accordance with one or more embodiments of the present disclosure. The variable flow resistance system 425 in FIG. 5 may be an alternative embodiment to the variable flow resistance system 425 in FIG. 4, in which like features have like reference numbers. As shown in FIG. 5, the power generator 448 may include a turbine or rotor that rotates at a rate directly related or proportional to the fluid flow rate through the power generator 448. The turbine or rotor may, thus, be used to measure the flow rate of fluid through the system 425. In another embodiment, the power generator 448 may include a vortex generator that vibrates at a rate directly related or proportional to the fluid flow rate through the power generator 448. The power generator 448 may thus be used in addition or in alternative to a flow rate sensor to measure fluid flow rate through the system 425.

Furthermore, though only one sensor and one actuator are shown in FIG. 4, the present disclosure is not so limited, as more than one sensor and/or more than one actuator may be used in accordance with the present disclosure. In such an embodiment, if using multiple sensors or actuators, the sensors and actuators used may be different from each other and/or may have different thresholds or tolerances than each other. For example, multiple different sensors may be used to measure different ranges of $CO_2$ concentration, pH, and/or fluid flow rate through the system 425 or be used redundantly with respect to each other, and multiple different actuators may be used to control the inflow rate of the fluid using different techniques or at different thresholds.

The variable flow resistance system 425 may further include a controller and corresponding electronics 446 to control and manage the operation of the components of the system 425. In one embodiment, the controller may be in communication with or coupled to the property sensor and the actuator 444 to control the actuator 444 based upon the measured property (e.g., $CO_2$ concentration, pH, flow rate) and/or measured fluctuations of the property. The controller may be used to receive the measured flow rates and compare the measured flow rates and fluctuations with a predetermined value. Based upon the comparison of the measured flow rates with that of the predetermined value, the controller may then move the actuator 444 to adjust the inflow rate of fluid received into the first flow path 438 of the system 425 appropriately.

As an example, in one or more embodiments, the controller may receive the property fluctuations measured by the sensor 442 and/or the power generator 448. The controller may then compare the measured property fluctuations with one or more predetermined patterns for the property fluctuations of the fluid to determine if a control signal has been included within the measured property fluctuations. If, based upon the comparison, a control signal has been received through the measured property or property fluctuations, the controller may be used to adjust the actuator 444 appropriately, such as to increase or decrease fluid flow through the system 425. A control signal may indicate not only what position to move the actuator 444 to control the flow rate into the system 425, but the control signal may also indicate when to move or adjust the position of the actuator 444.

While control signals may be received by the system 425, such as through measuring the property of fluid received by the system 425 discussed above, one or more signals may also be sent from the system 425 to other systems or receivers. For example, by controlling fluid property from a transmitter upstream, the system 425 may receive a control signal. Accordingly, the system 425 may also control the fluid property such that other systems or receivers downstream, either further downhole, uphole, or even close to the surface, depending on the direction of fluid flow, may receive a signal from the system 425. A signal may be sent to report properties measured by the system 425 and/or characteristics of the system 425 (e.g., fluid inflow rate into the system 425).

Further, a signal may be used to confirm that the system 425 is working properly and/or confirm downhole conditions of the well. The controller may, thus, use flow rate telemetry to not only receive a control signal, but may also use flow rate telemetry to control the actuator 444 as desired to send a signal through the flow rate of the fluid. Alternatively, the system 425 may be capable of using other types of telemetry besides flow rate telemetry, such as mud-pulse telemetry, pressure profile telemetry, acoustic pulse telemetry, and/or pseudo-static pressure profile telemetry.

As shown and discussed above, an actuator may be used with a controller to selectively adjust, enable, and restrict fluid flow to perform as a fluid flow rate controller. In one or more embodiments, a fluid flow rate controller may be positioned in series or in parallel with a power generator within a variable flow resistance system. Accordingly, FIGS. 6-10 show different schematic arrangements for the fluid flow through a variable flow resistance system with a fluid flow rate controller 402 and a power generator 404 positioned in series or in parallel within the system.

Figure 6:
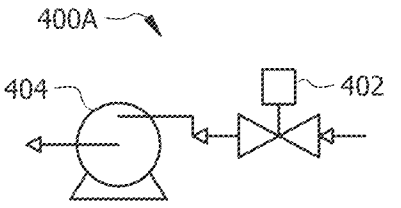
FIG. 6 is a schematic view of a variable flow device, according to embodiments of this disclosure.

In FIG. 6, a schematic view is shown of a variable flow resistance system 400A with the fluid flow rate controller 402 and the power generator 404 positioned in series within the system 400A. This arrangement of the system 400A is similar to the system 425 shown in the embodiment of FIG. 4. In FIG. 6, the flow path is arranged such that fluid flows through the fluid flow rate controller 402 and then the power generator 404, as indicated by the directional arrows. Fluid may also flow in the reverse direction such that fluid flows through the power generator 404 and then the fluid flow rate controller 402.

Figure 7:
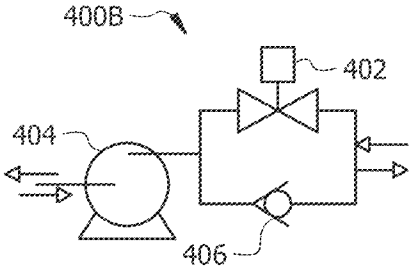
FIG. 7 is a schematic view of a variable flow device, according to embodiments of this disclosure.

In FIG. 7, a schematic view is shown of a variable flow resistance system 400B with the fluid flow rate controller 402 and the power generator 404 still positioned in series within the system 400B. In this embodiment, a check valve 406 is included within the system 400B and is positioned in parallel with the fluid flow rate controller 402. This embodiment enables the fluid flow rate controller 402 to control the fluid flow rate through the system 400B in one direction, while the power generator 404 is able to generate power from fluid flow in both directions through the system 400B. In another embodiment, the check valve 406 may be additionally or alternatively be positioned in parallel with the power generator 404.

Figure 8:
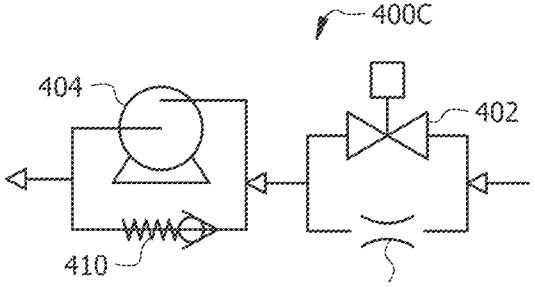
FIG. 8 is a schematic view of a variable flow device, according to embodiments of this disclosure.

In FIG. 8, a schematic view is shown of a variable flow resistance system 400C with the fluid flow rate controller 402 and the power generator 404 positioned in series within the system 400C. In this embodiment, a nozzle 408 and/or a relief valve 410 may be included within the system 400C. As shown, the nozzle 408 may be positioned in parallel with the fluid flow rate controller 402, and the relief valve 410 may be positioned in parallel with the power generator 404. The nozzle 408 is used in this embodiment to restrict but allow minimum fluid flow around the fluid flow rate controller 402. This arrangement enables fluid to still flow to the power generator 404 to generate power, even in a scenario when the fluid flow rate controller 402 is completely closed and preventing fluid flow therethrough. Further, the relief valve 410 may be used to relieve fluid pressure above a predetermined amount around the power generator 404.

Figure 9:
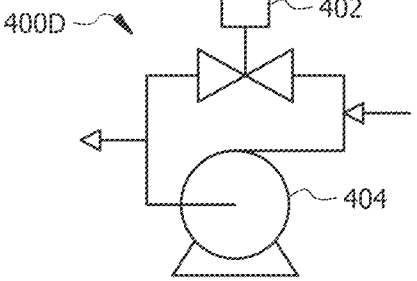
FIG. 9 is a schematic view of a variable flow device, according to embodiments of this disclosure.

In FIG. 9, a schematic view is shown of a variable flow resistance system 400D with the fluid flow rate controller 402 and the power generator 404 positioned in parallel within the system 400D. In this embodiment, the flow path is arranged such that fluid flows separately to the fluid flow rate controller 402 and the power generator 404. As such, fluid may flow to the power generator 404 to generate power, even when the fluid flow rate controller 402 is completely closed and preventing fluid flow therethrough.

Figure 10:
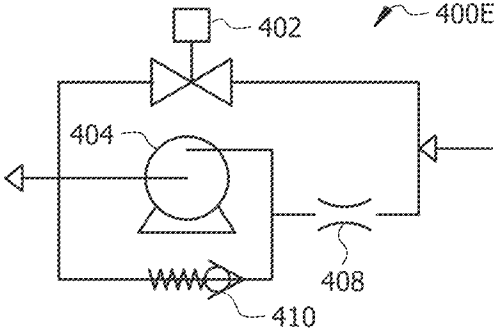
FIG. 10 is a schematic view of a variable flow device, according to embodiments of this disclosure.

In FIG. 10, a schematic view is shown of a variable flow resistance system 400E with the fluid flow rate controller 402 and the power generator 404 positioned in parallel within the system 400E. A nozzle 408 and a relief valve 410 are also included within the system 400E. The nozzle 408 is positioned in parallel with the fluid flow rate controller 402 to restrict the amount of fluid flow to the power generator 404. Further, the relief valve 410 is positioned in parallel with the power generator 404 to bypass the power generator 404 when fluid pressure is above a predetermined amount.

The preceding description provides various examples of the systems and methods of use disclosed herein which can contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps. The systems and methods can also "consist essentially of or "consist of the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as ranges from any lower limit may be combined with any other lower limit to recite a range not explicitly recited. In the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

One or more illustrative examples incorporating the examples disclosed herein are presented. Not all features of a physical implementation are described or shown in this application for the sake of clarity. Therefore, the disclosed systems and methods are well adapted to attain the ends and advantages mentioned, as well as those that are inherent therein. The particular examples disclosed above are illustrative only, as the teachings of the present disclosure can be modified and practiced in different but equivalent manners apparent to those skilled in the art having the benefit of the teachings herein. Furthermore, no limitations are intended to the details of construction or design herein shown other than as described in the claims below. It is therefore evident that the particular illustrative examples disclosed above may be altered, combined, or modified, and all such variations are considered within the scope of the present disclosure. The systems and methods illustratively disclosed herein may suitably be practiced in the absence of any element that is not specifically disclosed herein and/or any optional element disclosed herein.

Although the present disclosure and its advantages have been described in detail, it should be understood that various changes, substitutions and alterations can be made herein without departing from the spirit and scope of the disclosure as defined by the following claims.

Conventional carbon dioxide sequestration techniques that involve injecting carbonic acid downhole are limited to injecting fluid into the formation, wherein the fluid remains substantially static to allow a reaction to occur slowly over time. Unlike the method described herein, conventional approaches fail to describe a carbonic acid injection method that actively controls, enhance or optimizes the reaction rate downhole. The system and method of this disclosure can enable an increase of not only the rate of $CO_2$ sequestration, but can also, in applications, enable an increase in a total amount of $CO_2$ sequestered per foot of wellbore.

In embodiments, variable flow control devices (e.g., Equiflow Electric™ or "eICD"; also referred to herein as "active flow control devices"), fixed flow control devices (e.g., Equiflow Nozzle ICD's; also referred to herein as "passive flow control devices"), and zonal isolation (e.g., packers) can be utilized to effect $CO_2$ mineralization and achieve a desired productivity (e.g., a desired rate of $CO_2$ mineralization/sequestration downhole and/or total amount of $CO_2$ sequestered per foot of wellbore). In embodiments, the method can be utilized for electric completion and low carbon ventures.

In embodiments, a variable flow control device (e.g., an EICD, such as described in U.S. Pat. No. 11,105,183, the disclosure of which is hereby incorporated herein in its entirety for purposes not contrary to this disclosure) can be utilized as described herein in carbon dioxide sequestration applications.

To facilitate a better understanding of the present embodiments, the following examples of certain aspects of some embodiments are given. In no way should the following examples be read to limit, or define, the entire scope of the embodiments.

ADDITIONAL DISCLOSURE

The following are non-limiting, specific embodiments in accordance with the present disclosure:

In a first embodiment, a method comprises: pumping, via each of one or more first (e.g., injection) wells, a solution comprising carbonic acid produced via contact of carbon dioxide and water into each of a plurality of zones or intervals of a formation, wherein the solution flows via the each of the plurality of zones or intervals of the formation into one or more second wells via fractures or other permeabilities in the plurality of zones or intervals, and wherein the solution reacts with reactive rock in the plurality of zones or intervals of the formation to produce a solid (e.g., carbonate) and a resulting solution, wherein the resulting solution has a higher pH than a pH of the solution comprising carbonic acid; and producing, via one or more second (e.g., production) wells, the resulting solution that flows into the one or more second wells via the plurality of intervals; and monitoring, via a sensor, a property (e.g., pH and/or $CO_2$ concentration) of the resulting solution; and adjusting a flow rate of the pumping, a flow rate of the solution comprising carbonic acid flowing from the one or more first wells into one or more of (e.g., each of) the plurality of zones or intervals of the formation, a flow rate of the resulting solution flowing from one or more of (e.g., each of) the plurality of zones or intervals to the one or more second wells, or a combination thereof based on the property.

A second embodiment can include the method of the first embodiment, wherein each of the one or more first (e.g., injection) wells further comprise flow control devices (e.g., outflow control devices), each of the flow control devices configured to control a flow rate of the solution comprising carbonic acid from the first well into one of the plurality of zones or intervals of the formation, wherein the one or more second (e.g., production) wells further comprise flow control devices (e.g., inflow control devices), each of the flow control devices configured to control the flow rate of the resulting solution from one of the plurality of zones or intervals of the formation into one of the second (producing) wells, or a combination thereof.

A third embodiment can include the method of the second embodiment, wherein the flow control devices of the one or more first (e.g., injection) wells, the flow control devices of the of the one or more second (e.g., producing) wells, or both comprise adjustable flow control devices.

A fourth embodiment can include the method of the second or third embodiment, wherein each of the one or more first (e.g., injection) wells is divided into isolated portions via (and between) adjacent pairs of packers, wherein each of the isolated portions of said each first well is configured for pumping of the solution of carbonic acid into one of the plurality of zones or intervals of the formation, wherein each of the one or more second (e.g., production) wells is divided into isolated portions via (and between) adjacent pairs of packers, wherein each of the isolated portions of said each second well is configured for receiving the resulting solution from one of the plurality of zones or intervals of the formation, or a combination thereof.

A fifth embodiment can include the method of the fourth embodiment, wherein, for each of the one or more first wells, each flow control device thereof configured to control the flow rate of the solution comprising carbonic acid into the one of the plurality of zones or intervals of the formation is positioned in one of the isolated portions of said each first well; wherein, for each of the one or more second (e.g., production) wells, each flow control device thereof configured to control the flow rate of the resulting solution from the one of the plurality of zones or intervals of the formation into the one of the second (producing) wells is positioned in one of the isolated portions of said one second well; or a combination thereof.

A sixth embodiment can include the method of any one of the first to fifth embodiments further comprising increasing a flow rate of the solution comprising carbonic acid into one or more of the plurality of zones or intervals from which the property of the resulting solution exceeds (e.g., is greater than or less than) a threshold value.

A seventh embodiment can include the method of the sixth embodiment, wherein the property comprises a pH of the resulting solution, a $CO_2$ concentration of the resulting solution, or a combination thereof.

An eighth embodiment can include the method of the sixth or seventh embodiment, wherein the increasing is effected autonomously or is effected from the surface based on the monitored property.

A ninth embodiment can include the method of any one of the first to eighth embodiments further comprising: fracturing the formation prior to first pumping the solution comprising carbonic acid into the plurality of zones or intervals thereof; fracturing the formation subsequent pumping the solution comprising carbonic acid into the plurality of zones or intervals thereof for a time period; or both fracturing the formation prior to first pumping the solution comprising carbonic acid into the plurality of zones or intervals thereof and re-fracturing the formation subsequent pumping the solution comprising carbonic acid into the plurality of zones or intervals thereof for the time period.

A tenth embodiment can include the method of any one of the first to ninth embodiments further comprising: after a period of time, reversing flow direction by pumping the solution comprising carbonic acid via the one or more second (previously producing) wells, and producing the resulting solution via the one or more first (e.g., previously injection) wells.

An eleventh embodiment can include the method of any one of the first to tenth embodiments, wherein the formation comprises reactive rock selected from mafic rocks, ultramafic rocks and minerals and/or fragments thereof.

A twelfth embodiment can include the method of the eleventh embodiment, wherein the mafic rock comprises a silicate mineral or igneous rock that is rich in magnesium, calcium, and/or iron.

A thirteenth embodiment can include the method of the twelfth embodiment, wherein the mafic rock comprises mafic minerals selected from olivine, pyroxene, amphibole, and biotite.

A fourteenth embodiment can include the method of the twelfth or thirteenth embodiment, wherein the reactive rock comprises mafic rock selected from basalt, diabase, and gabbro, ultramafic rock selected from dunnite, peridotite, and/or pyroxenite, or a combination thereof.

A fifteenth embodiment can include the method of any one of the first to fourteenth embodiments further comprising utilizing heat of the resulting solution produced to the surface in a geothermal application.

A sixteenth embodiment can include the method of any one of the first to fifteenth embodiments further comprising: combining carbon dioxide with water to provide the solution comprising carbonic acid at or disparate from a location at which the pumping is effected; and/or combining carbon dioxide with water prior to introducing the solution comprising carbonic acid into the one or more first (e.g., injection) wells; introducing carbon dioxide and water separately into each of the one or more injection wells, wherein the solution comprising carbonic acid is formed therein; or a combination thereof.

In a seventeenth embodiment, a system comprises: one or more first (e.g., injection) wells, each of the one or more injection wells divided into isolated portions via (and between) adjacent pairs of packers, wherein each of the isolated portions of said each first well is configured for pumping of a solution of carbonic acid into one of a plurality of zones or intervals of a formation; one or more second (e.g., production) wells, each of the one or more second (e.g., production) wells divided into isolated portions via (and between) adjacent pairs of packers, wherein each of the isolated portions of said each second well is configured for receiving a resulting solution from one of the plurality of zones or intervals of the formation; a pump configured for pumping the solution comprising carbonic acid into the plurality of zones or intervals of the formation via the isolated portions of the injection well, whereby the solution comprising carbonic acid reacts with a reactive rock of the formation to produce a solid (e.g., carbonate) and the resulting solution, wherein the resulting solution has a higher pH than a pH of the solution comprising carbonic acid; and wherein each of the one or more first (e.g., injection) wells further comprises first well flow control devices, each of the flow control devices configured to control a flow rate of the solution comprising carbonic acid into one of the plurality of zones or intervals of the formation, wherein the one or more second (e.g., production) wells further comprise second well flow control devices, each of the flow control devices configured to control the flow rate of the resulting solution from one of the plurality of zones or intervals of the formation into one of the second (producing) wells, or a combination thereof.

An eighteenth embodiment can include the system of the seventeenth embodiment, wherein, for each of the one or more first wells, each flow control device thereof configured to control the flow rate of the solution comprising carbonic acid into the one of the plurality of zones or intervals of the formation is positioned in one of the isolated portions of said each first well; wherein, for each of the one or more second (e.g., production) wells, each flow control device thereof configured to control the flow rate of the resulting solution from the one of the plurality of zones or intervals of the formation into the one of the second (producing) wells is positioned in one of the isolated portions of said one second well; or a combination thereof.

A nineteenth embodiment can include the system of the seventeenth or eighteenth embodiment, wherein the first well flow control devices comprise adjustable flow rate flow control devices, wherein the second well flow control devices comprise adjustable flow rate flow control devices, or wherein both the first well flow control devices and the second well flow control devices comprise adjustable flow control devices.

A twentieth embodiment can include the system of the nineteenth embodiment, wherein the second well flow control devices comprise adjustable flow rate flow control devices.

A twenty first embodiment can include the system of the twentieth embodiment, wherein the first well flow control devices comprise fixed (non-adjustable flow rate) flow control devices.

A twenty second embodiment can include the system of any one of the seventeenth to twenty first embodiments further comprising, associated with each of the second well flow control devices, a sensor for measuring a property (e.g., pH and/or $CO_2$ concentration) of the resulting solution passing therethrough; and a controller operable for adjusting a flow rate of the pump, a flow rate of the solution comprising carbonic acid flowing from the one or more injection wells into one or more of (e.g., each of) the plurality of zones or intervals of the formation via the first well flow control devices, a flow rate of the resulting solution flowing from one or more of (e.g., each of) the plurality of zones or intervals to the one or more production wells via the second well flow control devices, or a combination thereof based on the property.

A twenty third embodiment can include the system of the twenty second embodiment, wherein the controller is above ground or downhole.

A twenty fourth embodiment can include the system of the twenty second or twenty third embodiment, wherein the property comprises pH, carbon dioxide concentration, or both.

A twenty fifth embodiment can include the system of the twenty fourth embodiment, wherein the controller adjusts a flow rate based on a difference between a pH of the carbonic acid solution pumped into the plurality of zones or intervals via the one or more first wells and a pH of the resulting solution received in one of the isolated portions of a second well.

A twenty sixth embodiment can include the system of the twenty fifth embodiment, wherein the controller is configured to increase a flow rate of the solution comprising carbonic acid into zones or intervals from which the resulting solution has an elevated pH and/or a reduced carbon dioxide concentration relative to a pH and/or carbon dioxide concentration, respectively, pumped thereto.

A twenty seventh embodiment can include the system of any one of the seventeenth to twenty sixth embodiments further comprising a heat exchanger configured to extract heat from the resulting fluid (e.g., for geothermal applications).

A twenty eighth embodiment can include the system of any one of the seventeenth to twenty seventh embodiments further comprising a flow line from an inlet line to one of the first wells to an outlet line of one of the second wells, whereby pumping can be reversed such that the solution of carbonic acid can be pumped into the one of the second wells and resulting solution can be removed from the one of the first wells to increase a total amount of carbon dioxide sequestered in the formation.

In a twenty ninth embodiment, a method comprises: pumping a solution comprising carbonic acid produced via contact of carbon dioxide and water into each of a plurality of zones intervals of a formation, wherein the solution flows via the each of the plurality of zones or intervals of the formation via fractures in the plurality of zones or intervals, and wherein the solution reacts with reactive rock in the plurality of zones or intervals of the formation to produce a solid (e.g., carbonate) and a resulting solution, wherein the resulting solution has a higher pH than a pH of the solution comprising carbonic acid; and producing the resulting solution from the formation; and monitoring a property (e.g., pH and/or $CO_2$ concentration) of the resulting solution; and adjusting a flow rate of the pumping, a flow rate of the solution comprising carbonic acid being pumped into one or more of (e.g., each of) the plurality of zones or intervals of the formation, a flow rate of the resulting solution being produced from one or more of (e.g., each of) the plurality of zones or intervals, or a combination thereof based on the property.

A thirtieth embodiment can include the method of the twenty ninth embodiment, wherein the property comprises a pH, a carbon dioxide concentration, or a combination thereof.

A thirty first embodiment can include the method of the thirtieth embodiment, wherein adjusting a flow rate based on the property comprises adjusting a flow rate based on a difference between the property of the resulting solution and a pH of the solution comprising carbonic acid being pumped.

A thirty second embodiment can include the method of any one of the twenty ninth to thirty first embodiments further comprising fracturing the formation in the one or more zones or intervals of the formation prior to and/or subsequent the pumping of the solution comprising carbonic acid for a duration of time.

A thirty third embodiment can include the method of any one of the twenty ninth to thirty second embodiments, further comprising, after a time period, reversing the pumping of the solution comprising carbonic acid such that the flow through the one or more zones or intervals is substantially reversed.

In a thirty fourth embodiment, a method comprises: pumping, via one or more injection wells, a pumped solution comprising carbonic acid into a plurality of permeable zones of a formation, producing, via one or more producer wells, a recovered solution that flows into one or more producer wells via the plurality of permeable zones; monitoring, via one or more sensors, a property of the recovered solution; and adjusting, based on the property, a flow rate of the recovered solution flowing from one or more of the plurality of permeable zones into the one or more producer wells.

A thirty fifth embodiment can include the method of the thirty fourth embodiment, wherein the property comprises a pH of the recovered solution, a $CO_2$ concentration of the recovered solution, or a combination thereof.

A thirty sixth embodiment can include the method of the thirty fifth embodiment, wherein the one or more producer wells further comprise adjustable flow control devices associated with each of the plurality of permeable zones, each of the flow control devices configured to control the flow rate of the recovered solution from the corresponding one of the plurality of permeable zones into one of the producer wells.

A thirty seventh embodiment can include the method of the thirty sixth embodiment, wherein the one or more sensors comprise a pH sensor located proximate each of the adjustable flow control devices.

A thirty eighth embodiment can include the method of the thirty seventh embodiment, wherein the adjusting, based on the property, further comprises adjusting, responsive to a change in pH of the recovered solution in comparison to an initial pH of the pumped solution, one or more of the flow control devices to reduce a flow rate of the recovered solution into the producer well.

A thirty ninth embodiment can include the method of the thirty eighth embodiment, wherein the change in pH results from contact of the pumped solution with rock in the permeable zones of the formation such that the carbonic acid reacts with the rock produce a solid and the recovered solution has a higher pH than the initial pH of the pumped solution.

A fortieth embodiment can include the method of the thirty eighth or thirty ninth embodiment, wherein the adjusting of the one or more flow control devices is effectuated autonomously in situ or is effectuated (e.g., controlled) via a command/control signal from a surface (e.g., of the earth/above ground).

A forty first embodiment can include the method of any one of the thirty fourth to fortieth embodiments, wherein (i) each of the one or more injection wells is divided into isolated portions via adjacent pairs of packers, each of the isolated portions of the injection wells is configured to flow the pumped solution into one of the plurality of permeable zones, (ii) each of the one or more producer wells is divided into isolated portions via adjacent pairs of packers, each of the isolated portions of the producer wells of the producer wells is configured to receive flow of the recovered solution from one of the plurality of permeable zones, or (iii) both (i) and (ii).

A forty second embodiment can include the method of any one of the thirty fifth to forty first embodiments further comprising adjusting, based on the property, a flow rate of the pumped solution flowing from the one or more injection wells into one or more of the plurality of permeable zones.

A forty third embodiment can include the method of the forty second embodiment, wherein each of the one or more injections wells further comprise adjustable flow control devices associated with each of the plurality of permeable zones, each of the flow control devices configured to control the flow rate of the pumped solution into one of the plurality of zones or intervals of the formation.

A forty fourth embodiment can include the method of the forty third embodiment, wherein the adjusting further comprises, responsive to a property of the recovered solution deviating a threshold amount from a designated amount (e.g., target/set point) for the property, increasing or decreasing the flow rate of the pumped solution into one or more of the plurality of permeable zones.

A forty fifth embodiment can include the method of any one of the thirty fifth to forty fourth embodiments further comprising adjusting, based on the property, a flow rate of one or more surface pumps (e.g., pumps above surface 140/240/340) pumping the pumped solution into the one or more injection wells.

A forty sixth embodiment can include the method of any one of the forty second to forty fifth embodiments further comprising adjusting, based on the property, a flow rate of one or more surface pumps pumping the pumped solution into the one or more injection wells.

A forty seventh embodiment can include the method of the forty fifth or forty sixth embodiments, wherein the adjusting further comprises, responsive to a property of the recovered solution deviating a threshold amount from a designated amount (e.g., target/set point) for the property, increasing or decreasing the flow rate of one or more surface pumps pumping the pumped solution into the one or more injection wells.

A forty eighth embodiment can include the method of any one of the thirty fourth to forty seventh embodiments further comprising: (i) prior to pumping the pumped solution, fracturing the formation to provide the plurality of permeable zones; (ii) subsequent pumping the pumped solution for a period of time, re-fracturing the formation to enhance permeability of the plurality of permeable zones; or (iii) both (i) and (ii).

A forty ninth embodiment can include the method of any one of the thirty fourth to forty eighth embodiments further comprising: after a period of time, reversing flow direction by pumping the pumped solution into the one or more producer wells, and producing the recovered solution via the one or more injection wells.

A fiftieth embodiment can include the method of any one of the thirty ninth to forty ninth embodiments, wherein the formation comprises reactive rock selected from mafic rocks, ultramafic rocks and minerals and/or fragments thereof.

In a fifty first embodiment, a method comprises: pumping a solution comprising carbonic acid into each of a plurality of zones intervals of a formation, wherein the solution flows via the each of the plurality of zones of the formation via fractures in the plurality of zones, and wherein the solution reacts with reactive rock in the plurality of zones or intervals of the formation to produce a solid and a resulting solution, wherein the resulting solution has a higher pH than a pH of the solution comprising carbonic acid; and producing the resulting solution from the formation; and monitoring a property of the resulting solution; and adjusting a flow rate of the pumping, a flow rate of the solution comprising carbonic acid being pumped into one or more of the plurality of zones or intervals of the formation, a flow rate of the resulting solution being produced from one or more of the plurality of zones or intervals, or a combination thereof based on the property.

A fifty second embodiment can include the method of the fifty first embodiment, wherein the property comprises a pH, a carbon dioxide concentration, or a combination thereof.

A fifty third embodiment can include the method of the fifty second embodiment, wherein adjusting a flow rate based on the property comprises adjusting a flow rate based on a difference between a pH of the resulting solution and a pH of the solution comprising carbonic acid.

In a fifty fourth embodiment, a system comprises: one or more first wells, each of the one or more first wells divided into isolated portions via adjacent pairs of packers, wherein each of the isolated portions of said each first well is configured for pumping of a solution of carbonic acid into one of a plurality of permeable zones of a formation; one or more second wells, each of the one or more second wells divided into isolated portions via adjacent pairs of packers, wherein each of the isolated portions of said each second well is configured for receiving a resulting solution from one of the plurality of permeable zones of the formation; a pump configured for pumping the solution comprising carbonic acid into the plurality of zones of the formation via the isolated portions of the first well, whereby the solution comprising carbonic acid reacts with a reactive rock of the formation to produce a solid and the resulting solution, wherein the resulting solution has a higher pH than a pH of the solution comprising carbonic acid; and (i) the one or more first wells further comprise first well flow control devices, each of the flow control devices configured to control a flow rate of the solution comprising carbonic acid into one of the plurality of zones or intervals of the formation, (ii) the one or more second wells further comprise second well flow control devices, each of the flow control devices configured to control the flow rate of the resulting solution from one of the plurality of zones or intervals of the formation into one of the second wells, or (iii) both (i) and (ii).

A fifty fifth embodiment can include the system of the fifty fourth embodiment further comprising, associated with each of the second well flow control devices, a sensor for measuring a property of the resulting solution passing therethrough; and/or a controller operable for adjusting, based on the property, (i) a flow rate of the pump, (ii) a flow rate of the solution comprising carbonic acid flowing from the one or more first wells into one or more of the plurality of zones or intervals of the formation via the first well flow control devices, (iii) a flow rate of the resulting solution flowing from one or more of the plurality of zones or intervals to the one or more second wells via the second well flow control devices, or (iv) any combination of (i)-(iii).

While embodiments have been shown and described, modifications thereof can be made by one skilled in the art without departing from the spirit and teachings of this disclosure. The embodiments described herein are exemplary only, and are not intended to be limiting. Many variations and modifications of the embodiments disclosed herein are possible and are within the scope of this disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=Rl+k*(Ru−Rl), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of broader terms such as comprises, includes, having, etc. should be understood to provide support for narrower terms such as consisting of, consisting essentially of, comprised substantially of, etc. When a feature is described as "optional," both embodiments with this feature and embodiments without this feature are disclosed. Similarly, the present disclosure contemplates embodiments where this "optional" feature is required and embodiments where this feature is specifically excluded.

Accordingly, the scope of protection is not limited by the description set out above but is only limited by the claims which follow, that scope including all equivalents of the subject matter of the claims. Each and every claim is incorporated into the specification as embodiments of the present disclosure. Thus, the claims are a further description and are an addition to the embodiments of the present disclosure. The discussion of a reference herein is not an admission that it is prior art, especially any reference that can have a publication date after the priority date of this application. The disclosures of all patents, patent applications, and publications cited herein are hereby incorporated by reference, to the extent that they provide exemplary, procedural, or other details supplementary to those set forth herein.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A method comprising:

pumping, via one or more injection wells, a pumped solution comprising carbonic acid into a plurality of permeable zones of a formation comprising reactive rock, whereby the solution comprising carbonic acid reacts with a reactive rock of the formation to produce a solid carbonate, producing, via one or more producer wells, a recovered solution that flows into one or more producer wells via the plurality of permeable zones;

monitoring, via one or more sensors, a property of the recovered solution; and adjusting, based on the property of the recovered solution, a flow rate of the recovered solution flowing from one or more of the plurality of permeable zones into the one or more producer wells, wherein the adjusting, based on the property, comprises substantially real time adjusting, responsive to a change in the property, one or more flow control devices to reduce or increase a flow rate of the recovered solution into the producer well.

2. The method of claim 1, wherein the property comprises a pH of the recovered solution, a $CO_2$ concentration of the recovered solution, or a combination thereof.

3. The method of claim 2, wherein the one or more producer wells further comprise adjustable flow control devices associated with each of the plurality of permeable zones, each of the flow control devices configured to control the flow rate of the recovered solution from the corresponding one of the plurality of permeable zones into one of the producer wells.

4. The method of claim 3, wherein the one or more sensors comprise a pH sensor located proximate each of the adjustable flow control devices.

5. The method of claim 4, wherein the adjusting, based on the property, further comprises adjusting, responsive to a change in pH of the recovered solution in comparison to an initial pH of the pumped solution, one or more of the flow control devices to reduce a flow rate of the recovered solution into the producer well.

6. The method of claim 5, wherein the change in pH results from contact of the pumped solution with rock in the permeable zones of the formation, whereby the carbonic acid reacts with the rock to produce the solid carbonate and the recovered solution that has a higher pH than the initial pH of the pumped solution.

7. The method of claim 5, wherein the adjusting of the one or more flow control devices is effectuated autonomously in situ or is effectuated via a command/control signal from a surface.

8. The method of claim 2, further comprising adjusting, based on the property, a flow rate of the pumped solution flowing from the one or more injection wells into one or more of the plurality of permeable zones.

9. The method of claim 8, wherein each of the one or more injections wells further comprise adjustable flow control devices associated with each of the plurality of permeable zones, each of the flow control devices configured to control the flow rate of the pumped solution into one of the plurality of zones or intervals of the formation.

10. The method of claim 9, wherein the adjusting further comprises, responsive to a property of the recovered solution deviating a threshold amount from a designated amount for the property, increasing or decreasing the flow rate of the pumped solution into one or more of the plurality of permeable zones.

11. The method of claim 9, further comprising adjusting, based on the property, a flow rate of one or more surface pumps pumping the pumped solution into the one or more injection wells.

12. The method of claim 2, further comprising adjusting, based on the property, a flow rate of one or more surface pumps pumping the pumped solution into the one or more injection wells.

13. The method of claim 12, wherein the adjusting further comprises, responsive to a property of the recovered solution deviating a threshold amount from a designated amount for the property, increasing or decreasing the flow rate of one or more surface pumps pumping the pumped solution into the one or more injection wells.

14. The method of claim 1, wherein (i) each of the one or more injection wells is divided into isolated portions via adjacent pairs of packers, each of the isolated portions of the injection wells is configured to flow the pumped solution into one of the plurality of permeable zones, (ii) each of the one or more producer wells is divided into isolated portions via adjacent pairs of packers, each of the isolated portions of the producer wells of the producer wells is configured to receive flow of the recovered solution from one of the plurality of permeable zones, or (iii) both (i) and (ii).

15. The method of claim 1 further comprising:

(i) prior to pumping the pumped solution, fracturing the formation to provide the plurality of permeable zones;

(ii) subsequent pumping the pumped solution for a period of time, re-fracturing the formation to enhance permeability of the plurality of permeable zones; or (iii) both (i) and (ii).

16. The method of claim 1 further comprising:

after a period of time, reversing flow direction by pumping the pumped solution into the one or more producer wells, and producing the recovered solution via the one or more injection wells.

17. The method of claim 1, wherein the formation comprises reactive rock selected from mafic rocks, ultramafic rocks and minerals and/or fragments thereof.

18. The method of claim 1, wherein the one or more flow control devices include: one or more outflow control devices, each of the outflow devices configured to control a flow rate of the solution comprising carbonic acid from one of the one or more injection wells into one of the plurality of zones or intervals of the formation, one or more inflow control devices, each of the inflow control devices configured to control the flow rate of the recovered solution from one of the plurality of zones or intervals of the formation into one of the one or more producing wells; or a combination thereof.

* * * * *